US007274341B2

(12) United States Patent
Ohno et al.

(10) Patent No.: US 7,274,341 B2
(45) **Date of Patent: *Sep. 25, 2007**

(54) ANTENNA MOUNTING STRUCTURE

(75) Inventors: Sadao Ohno, Gunma (JP); Motonao Takahashi, Gunma (JP); Kazuki Katono, Gunma (JP); Keisuke Yamaya, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 50 days.

This patent is subject to a terminal disclaimer.

(21) Appl. No.: 11/254,780

(22) Filed: Oct. 21, 2005

(65) Prior Publication Data

US 2006/0038729 A1 Feb. 23, 2006

Related U.S. Application Data

(63) Continuation-in-part of application No. 10/902,178, filed on Jul. 30, 2004, now Pat. No. 7,046,207.

(30) Foreign Application Priority Data

Jul. 31, 2003 (JP) ..... P2003-204782
Oct. 22, 2004 (JP) ..... P2004-308804
Jul. 25, 2005 (JP) ..... P2005-214831

(51) Int. Cl.
*H01Q 1/12* (2006.01)

(52) U.S. Cl. ..... 343/878; 343/713

(58) Field of Classification Search ..... 343/711, 343/713, 715, 878

See application file for complete search history.

(56) References Cited

U.S. PATENT DOCUMENTS 2,392,491 A 1/1946 Moran
6,879,301 B2 4/2005 Kozlovski ..... 343/878
7,046,207 B2 * 5/2006 Takahashi ..... 343/711
2003/0068198 A1 4/2003 Kozlovski (Continued)

FOREIGN PATENT DOCUMENTS

DE 102 10 593 A1 9/2003

(Continued)

*Primary Examiner*—Tan Ho
(74) *Attorney, Agent, or Firm*—Morgan, Lewis & Bockius LLP

(57) ABSTRACT

A structure for mounting an antenna device on a first side of a panel body is disclosed. A first fixation member includes a first end having a first width, a second end, and a slit connecting the first end and the second end. A protrusion is protruded from the antenna device and fitted into the first end of the first fixation member. A second fixation member is fitted into the second end of the first fixation member while being coupled with the protrusion in a screwing manner. The first width is smaller than an aperture formed in the panel body when the protrusion and the second fixation member are in a first screwing position, so that the protrusion, the first fixation member and the second fixation member are allowed to pass through the aperture from the first side to a second side thereof. The slit is expanded such that the first end of the first fixation member is made to have a second width which is greater than the aperture when the protrusion and the second fixation member are in a second screwing position where the protrusion and the second fixation member are closed to each other than the first screwing position.

9 Claims, 30 Drawing Sheets

U.S. PATENT DOCUMENTS

| | | | | |
|---|---|---|---|---|
| 2003/0231140 | A1 | 12/2003 | Haussler et al. | |
| 2005/0237248 | A1* | 10/2005 | Nakano et al. | 343/711 |
| 2006/0077112 | A1* | 4/2006 | Nakano et al. | 343/715 |

FOREIGN PATENT DOCUMENTS

| | | |
|---|---|---|
| DE | 20 2004 007 160 U1 | 7/2004 |
| JP | B2-2751146 | 2/1998 |
| JP | 2005-45581 | 2/2005 |
| WO | WO 2005/051720 A1 | 6/2005 |

* cited by examiner

ANTENNA MOUNTING STRUCTURE

CROSS-REFERENCE OF THE APPLICATION

This is a continued-in-part (CIP) application of Ser. No. 10/902,178 which was filed on Jul. 30, 2004 now U.S. Pat. No. 7,046,207.

BACKGROUND OF THE INVENTION

The present invention relates to an antenna mounting structure in which an antenna base of a vehicle antenna is mounted on and fixed to a roof or the like of a vehicle body.

In a conventional structure for mounting a vehicle antenna to a roof or the like of a vehicle body, a bolt protruded downward from the antenna base of the antenna device for a vehicle is inserted through a hole formed on the roof and a washer having a claw is fitted and inserted from below into the bolt protruded downward from the roof, and furthermore, a nut is screwed and fixed. In order to enhance a workability, the washer having a claw and the nut are coupled and integrated so as to be relatively rotatable around a screw axis and not to be separated from each other in the direction of the screw axis. In order to enhance the workability, furthermore, Japanese Patent No. 2751146 has proposed a technique for provisionally fixing a nut to a bolt through a washer having a claw. According to the proposed technique, the nut can be prevented from slipping from the bolt even if an operator releases his or her hand from the nut after the provisional fixation. Consequently, the workability can be improved.

In this structure, the nut can be prevented from slipping off even if an operator releases his or her hand from the nut after the nut is provisionally fixed to the bolt, thereby improving the workability. However, it is necessary to carry out a working step of provisionally fixing the nut, from below a roof panel or the like, to the bolt inserted through the hole from above the roof panel or the like.

SUMMARY OF THE INVENTION

It is therefore an object of the invention to provide an antenna mounting structure capable of provisionally fixing an antenna base by an insertion through a hole of a roof panel or the like from above, thereby further improving the workability.

In order to achieve the above object, according to the invention, there is provided a structure for mounting an antenna device on a first side of a panel body, comprising:

a first fixation member, having a tubular body, including a first end having a first width, a second end, and a slit connecting the first end and the second end;

a protrusion, protruded from the antenna device and fitted into the first end of the first fixation member; and a second fixation member, fitted into the second end of the first fixation member while being coupled with the protrusion in a screwing manner, wherein:

the first width is smaller than an aperture formed in the panel body when the protrusion and the second fixation member are in a first screwing position, so that the protrusion, the first fixation member and the second fixation member are allowed to pass through the aperture from the first side to a second side thereof; and the slit is expanded such that the first end of the first fixation member is made to have a second width which is greater than the aperture when the protrusion and the second fixation member are in a second screwing position where the protrusion and the second fixation member are closed to each other than the first screwing position.

The structure may further comprise a wedge member, formed on at least one of the protrusion and the second fixation member. The wedge member may be fitted into the slit when the protrusion and the second fixation member are in the first screwing position. The wedge member may be configured so as to expand the slit when the protrusion and the second fixation member are in the second screwing position.

Here, the wedge member may be formed with a cutout portion, and a cable may be extending from the antenna device and led to the second side of the panel body while passing through the cutout portion and the aperture.

Further, the structure may further comprise a plurality of claws, provided on the first end of the first fixation member at positions that are both sides of the slit. The claws may be adapted to be bite into a second side of the panel body. The second fixation member may be rotated in a first direction to be placed in the second screwing position. The wedge member may have a slope face configured such that one of the claws, which is moved in the first direction in accompany with the rotation of the second fixation member, is abutted against the slope face and guided in a second direction opposite to the first direction while the second fixation member is moved to the second screwing member.

Here, the wedge member may be arranged at a position deviated in the second direction from a symmetric line of the aperture.

A first end of the second fixation member which is first fitted into the second end of the first fixation member may have a first diameter and a second end of the second fixation member may have a second diameter which is larger than the first diameter.

The aperture and the protrusion may be shaped into rectangular.

The second fixation member may be a bolt member adapted to be screwed into a hole formed in the protrusion, and the bolt may have a head portion adapted to be fitted into the second end of the first fixing member to assist the wedge member to expand the slit.

The second fixation member may be a nut member adapted to be fitted into the second end of the first fixing member and screwed on a bolt formed on the protrusion to assist the wedge member to expand the slit of the first fixation member.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
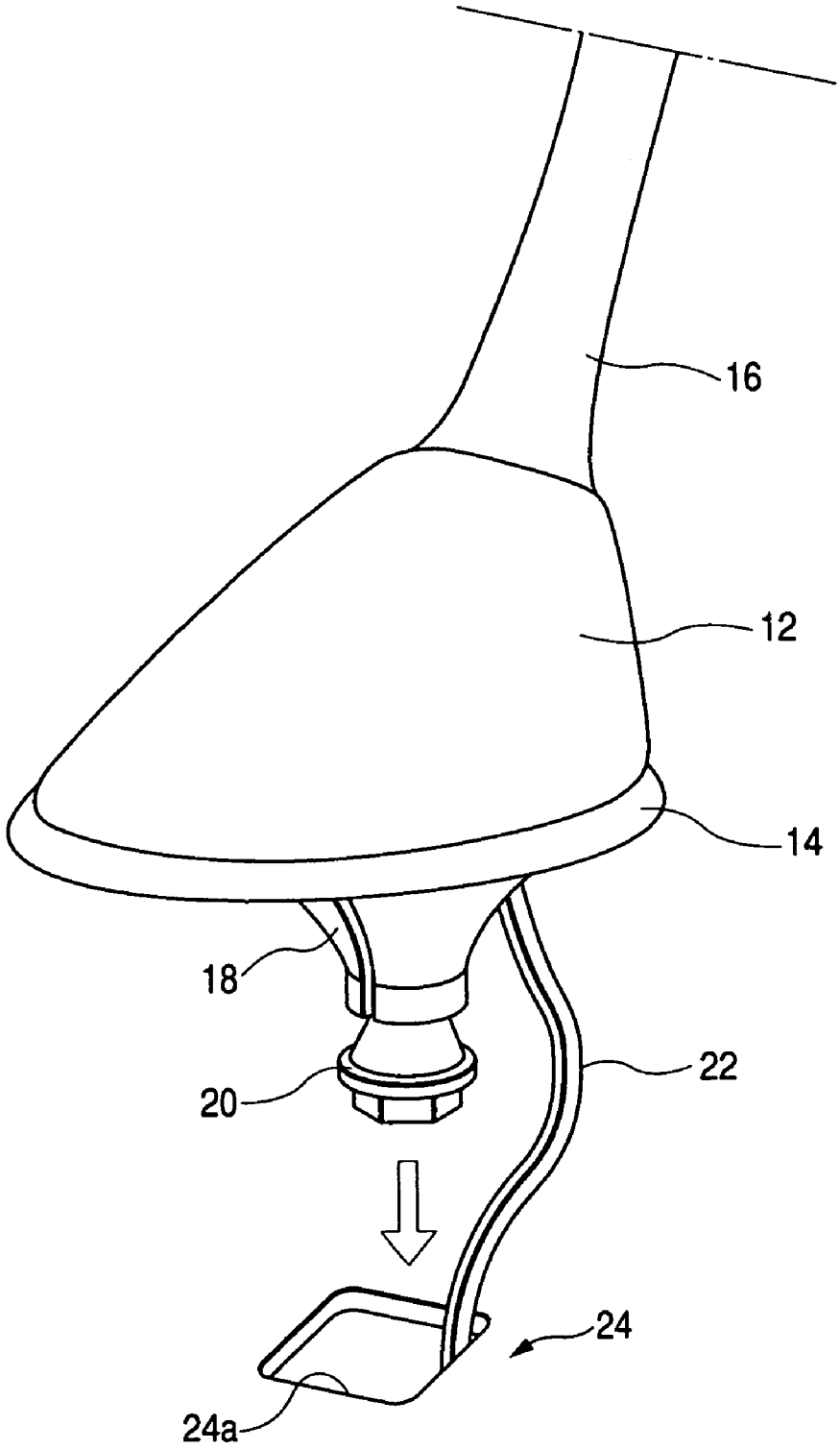
FIG. 1 is a perspective view showing an external appearance of an antenna device incorporating an antenna mounting structure according to a first embodiment of the invention.
Figure 2A:
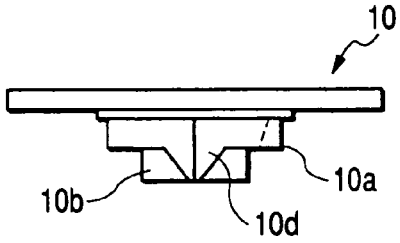
FIG. 2A is a front view of an antenna base in the antenna mounting structure of FIG. 1.
Figure 2B:
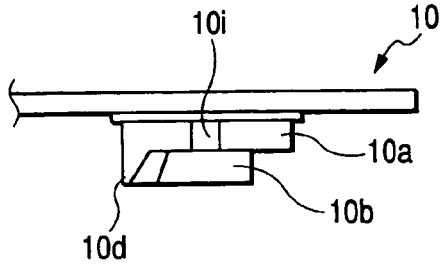
FIG. 2B is a side view of the antenna base of FIG. 2A.
Figure 2C:
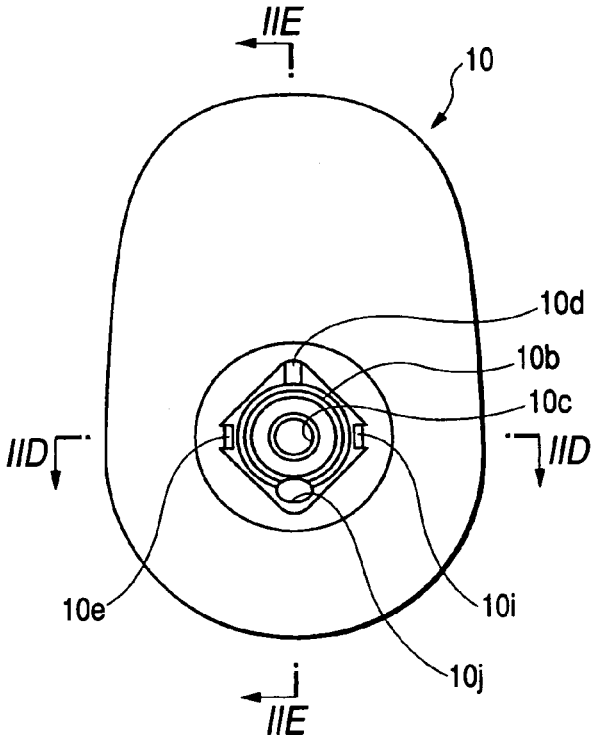
FIG. 2C is a bottom view of the antenna base of FIG. 2A.
Figure 2E:
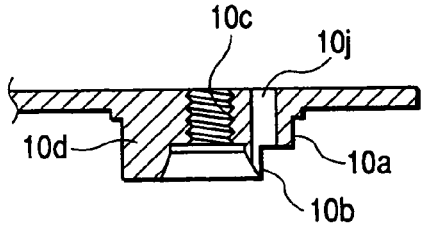
FIG. 2E is a section view taken along a line IIE-IIE in FIG. 2C.
Figure 2D:
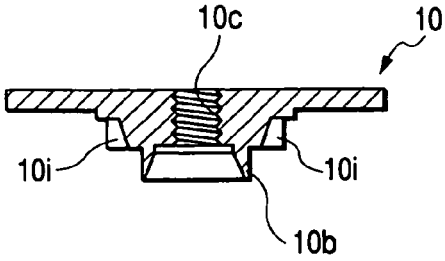
FIG. 2D is a section view taken along a line IID-IID in FIG. 2C.
Figure 3A:
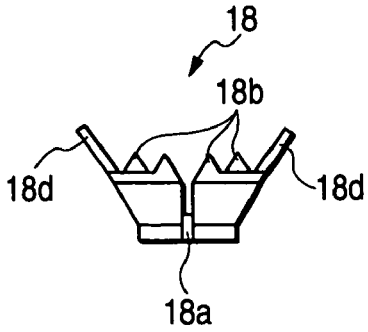
FIG. 3A is a front view of a claw washer in the antenna mounting structure of FIG. 1.
Figure 3B:
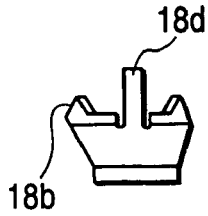
FIG. 3B is a side view of the claw washer of FIG. 3A.
Figure 3C:
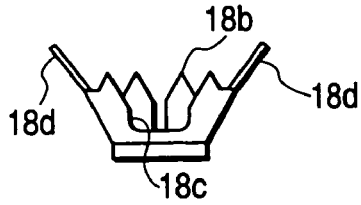
FIG. 3C is a rear view of the claw washer of FIG. 3A.
Figure 3D:
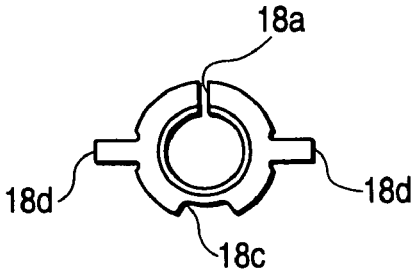
FIG. 3D is a bottom view of the claw washer of FIG. 3A.
Figure 3E:
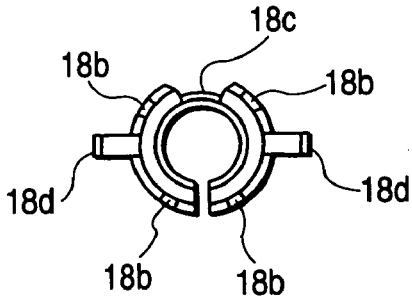
FIG. 3E is a top view of the claw washer of FIG. 3A.

FIG. 1 shows a vehicle antenna according to a first embodiment of the invention. Specifically, an antenna base 10 shown in FIGS. 2A to 2E is fixed within a housing 12. An amplifying circuit (not shown) is also accommodated in the housing 12. Moreover, the base end of an antenna element 16 is fixed to the housing 12.

Figure 4B:
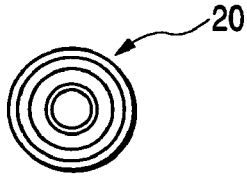
FIG. 4B is a top view of the bolt of FIG. 4A.
Figure 4A:
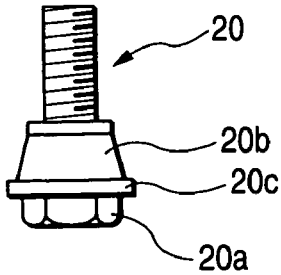
FIG. 4A is a side view of a bolt in the antenna mounting structure of FIG. 1.
Figure 4C:
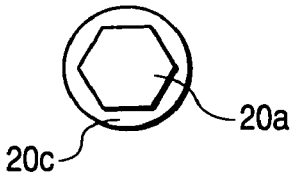
FIG. 4C is a bottom view of the bolt of FIG. 4A.

The tip of a bolt 20 shown in FIGS. 4A to 4C is screwed into the antenna base 10 from below as described later in detail. Moreover, a claw washer 18 shown in FIGS. 3A to 3E is fitted with the bolt 20. Furthermore, a cable 22 such as a signal transmission line is led from the antenna base 10. With such a structure, as shown in FIG. 1, the cable 22 is first inserted from above into a hole 24*a* provided on a roof panel or the like of a vehicle body 24, and furthermore, the bolt 20 and the claw washer 18 are inserted therein to carry out a provisional fixation.

As shown in FIGS. 2A to 2E, the antenna base 10 is formed of a conductive material, and has a lower face provided with a square protrusion 10*a*. A cylindrical projection 10*b* is provided on the center of the square protrusion 10*a*. A female screw 10*c* is threaded in a vertical direction at the center of cylindrical projection 10*b*. A wedge-shaped member 10*d* in which the lower end thereof is narrowed is formed so as to connect one corner of the square protrusion 10*a* and the peripheral face of the cylindrical projection 10*b*. Grooves 10*i* are formed at two corners of the square protrusion 10*a* which are adjacent to the corner at which the wedge-shaped member is provided. The grooves 10*i* are for receiving provisional fixation claws 18*d* (described later in detail). A hole 10*j* penetrating the antenna base 10 in a vertical direction is formed in the vicinity of a corner of the square protrusion 10*a* which is opposite to the corner at which the wedge-shaped member is provided. The hole 10*j* is for allowing the cable 22 to pass therethrough.

As shown in FIGS. 3A to 3E, the claw washer 18 is formed by a conductive material plate and is shaped into a truncated cone in which a lower end diameter is less than an upper end diameter. The claw washer 18 is formed with a slit 18*a* so as to connect the upper end and the lower end thereof, so that the claw washer 18 is C-shaped in the plan view. At the upper end of the claw washer 18, there are formed four claws 18*b* projecting upward and two provisional fixation claws 18*d* projecting obliquely upward and outward. The distal ends of the provisional fixation claws 18*d* are situated upper and outer than the distal ends of the claws 18*b*. A notch 18*c* is formed for receiving the cable 22.

As shown in FIGS. 4A to 4C, the bolt 20 is formed of a conductive material. A screw body and a hexagonal head portion 20*a* are connected by a flange portion 20*c* and a truncated-conical portion 20*b*. The upper end of the truncated-conical portion 20*b* has an outer diameter which is slightly smaller than the inner diameter of the lower end of the claw washer 18 in an original state. The lower end of the truncated-conical portion 20*b* has an outer diameter which is larger than the inner diameter of the lower end of the claw washer 18 in an original state.

The antenna base 10 is fixed to the housing 12 in advance and the rubber packing member 14 is attached to the lower portion of the antenna base 10. The cable 22 is led from the inside of the housing 12 through the hole 10*j* of the antenna base 10. The bolt 20 is fitted and inserted into the claw washer 18 and the tip portion of the bolt 20 is screwed into the female screw 10*c* of the antenna base 10 so that the bolt 20 and the claw washer 18 are integrated with the antenna base 10. The rubber packing member 14 is provided with a hole through which the square protrusion 10*a* of the antenna base 10 can penetrate.

Figure 5A:
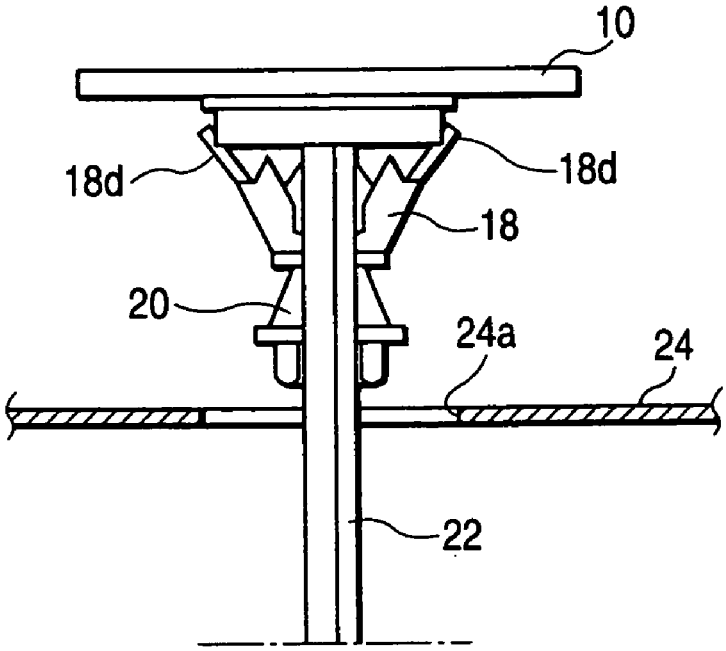
FIG. 5A is a side view showing a state before the antenna base of FIG. 2A is provisionally fixed on a vehicle body
Figure 5B:
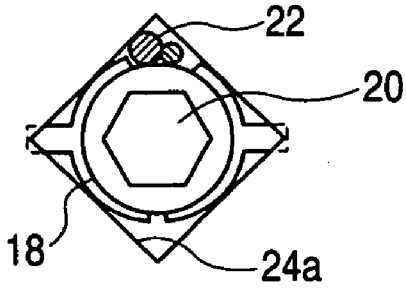
FIG. 5B is a bottom plan view showing the state of FIG. 5A.
Figure 6A:
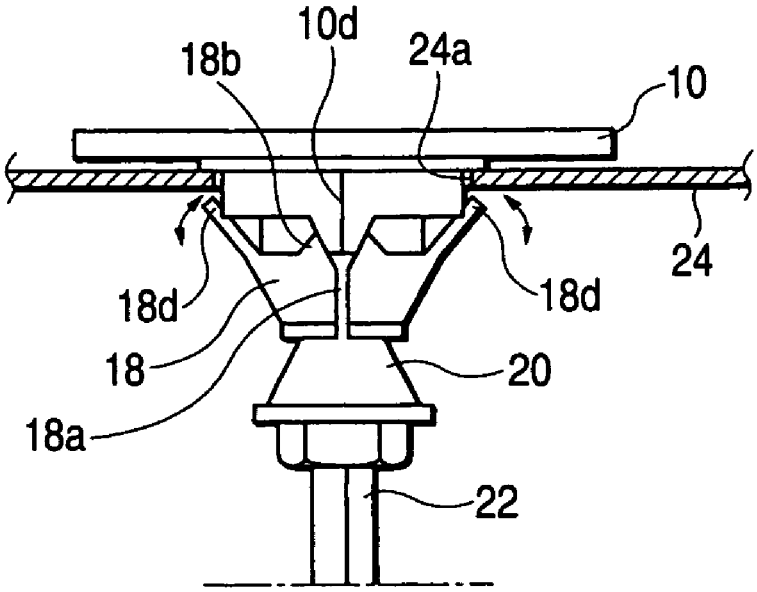
FIG. 6A is a side view showing a state that the antenna base of FIG. 2A is provisionally fixed on the vehicle body.
Figure 6B:
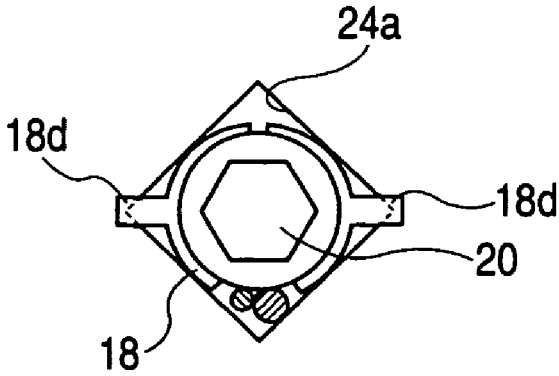
FIG. 6B is a bottom plan view showing the state of FIG. 6A.

In such an integrated state, as shown in FIGS. 1, 5A and 5B, the cable 22 is first inserted into the hole 24*a* provided on the roof panel or the like to bring a condition in which the square protrusion 10*a* of the antenna base 10 faces the hole 24*a*. The hole 24*a* takes an almost square shape which is slightly larger than the square protrusion 10*a*. When the cable 22 is inserted into the hole 24*a* from above in the state of FIG. 5, the provisional fixation claws 18*d* are elastically deformed on two opposed corners of the hole 24*a*, thereby permitting the insertion. After a passage through the hole 24*a*, the provisional fixation claws 18*d* are elastically returned and tips thereof are positioned in the peripheral edge portion of the hole 24*a* so that a state shown in FIGS. 6A and 6B is brought. Here, the antenna base 10 is provisionally fixed to the hole 24*a* of the roof by the provisional fixation claws 18*d*.

Figure 7A:
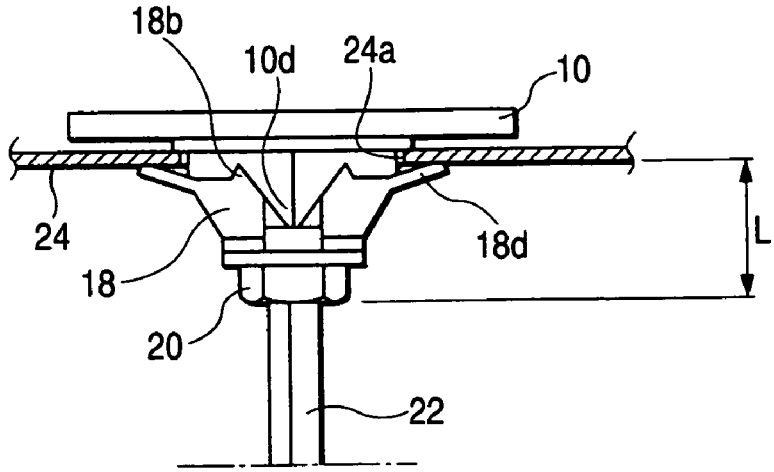
FIG. 7A is a side view showing a state that the antenna base of FIG. 2A is plenarily fixed on the vehicle body.
Figure 7B:
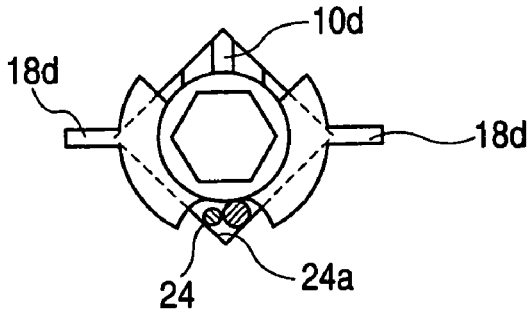
FIG. 7B is a bottom plan view showing the state of FIG. 7A.
Figure 7C:
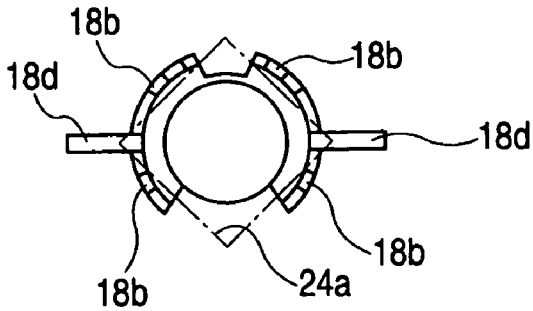
FIG. 7C is a schematic top plan view showing the state of FIG. 7A.

When the bolt 20 is screwed into the female screw 10*c* of the antenna base 10, the tips of the provisional fixation claws 18*d* are first expanded over the back face of the roof panel or the like. On the other hand, the wedge-shaped member 10*d* expands the slit 18*a* of the claw washer 18 from above by a wedge effect, and the truncated-conical portion 20*b* of the bolt 20 also expands the slit 18*a* from below so that the diameter of the almost C shape of the claw washer 18 is more increased. As a result, as shown in FIGS. 7A to 7C, the claws 18*b* of the claw washer 18 are positioned in the peripheral edge portion of the hole 24*a* and cut into the back face of the roof panel or the like by the strong fastening of the bolt 20. Accordingly, the antenna base 10 is plenarily fixed to the roof panel or the like, while the electrical connection of the antenna base 10 and the roof panel or the like is established by the claws 18*b*.

With such a structure, a member obtained by integrating the claw washer 18 and the bolt 20 with the antenna base 10 is simply inserted into the hole 24*a* from above the roof panel or the like so that the antenna base 10 can be provisionally fixed to the roof panel or the like. Thus, the provisional fixation work can easily be carried out. The bolt 20 is rotated axially with the head portion 20*a* held by a tool from below the roof panel or the like, and is thus screwed and fastened. Consequently, the claws 18*b* of the claw washer 18 cut into the back face of the roof panel or the like, and are thus fixed reliably and are electrically connected. In addition, since the hole 24*a* of the roof panel or the like takes the almost square shape, the square protrusion 10*a* of the antenna base 10 is fixed to the roof in a constant posture.

Figure 8:
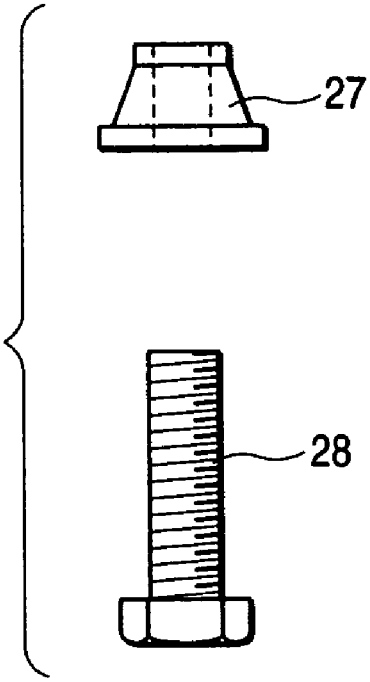
FIG. 8 is a side view of a bolt in an antenna mounting structure according to a second embodiment of the invention.

FIG. 8 shows a second embodiment of the invention. In this embodiment, a bolt is constituted by two members including a bush 27 taking the shape of a truncated cone and a screw 28 having a hexagonal head portion. The bush 27 has an upper outer diameter which is slightly smaller than the lower inner diameter of the claw washer 18, and a lower outer diameter set to be larger than the lower inner diameter of the claw washer 18 as in the first embodiment.

Figure 9A:
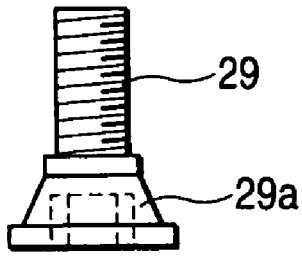
FIG. 9A is a side view of a bolt in an antenna mounting structure according to a third embodiment of the invention.
Figure 9B:
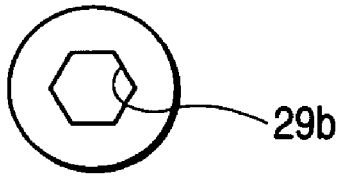
FIG. 9B is a bottom view of the bolt of FIG. 9A.

FIGS. 9A and 9B show a third embodiment of the invention. In this embodiment, the hexagonal head portion in the first embodiment is omitted. Instead, a bottomed hole 29*b* having a hexagonal cross section is formed on a bottom face of a truncated-conical portion 29*a* of a bolt 29. By inserting a hexagonal wrench into the bottomed hole 29*b*, it is possible to rotate the bolt 29 to perform the screwing operation. When the screw 30 is screwed and fastened to fix the antenna base 10 to the roof, according to the omission of the head portion, a dimension L protruded from the back face of the roof panel or the like shown in FIG. 7 can be reduced effectively.

Figure 10A:
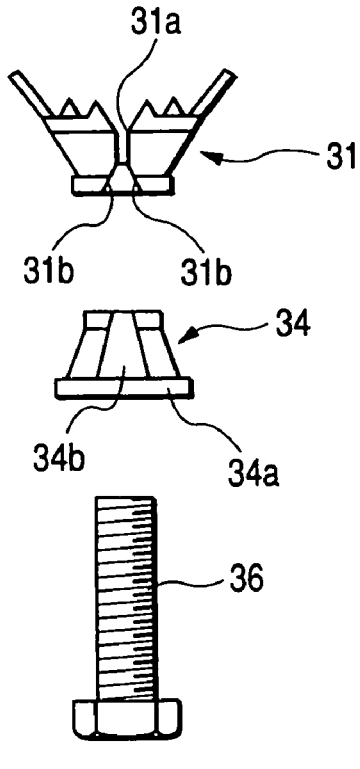
FIG. 10A is a side view of a bolt in an antenna mounting structure according to a fourth embodiment of the invention.
Figure 10B:
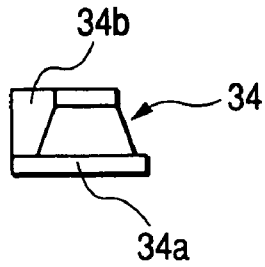
FIG. 10B is a side view of a bush in the antenna mounting structure of FIG. 10A.

FIGS. 10A and 10B show a fourth embodiment of the invention. In this embodiment, a claw washer 31 is provided with a slit 31*a* having a tapered portion 31*b* formed at the lower end portion thereof such that a clearance is enlarged toward the lower side. A bush 34 has an upper outer diameter which is slightly smaller than a lower inner diameter of the claw washer 31 and a lower outer diameter which is set to be larger than the lower inner diameter of the claw washer 31. Moreover, a flange portion 34*a* is provided on the lower end of the bush 34, and a wedge-shaped member 34*b* to be inserted into the tapered portion 31*b* of the claw washer 31 to expand the clearance of the slit 31*a* is formed on an outer peripheral face of the bush 34. Furthermore, there is provided a bolt 36 for penetrating through the claw washer 31 and the bush 34 in a vertical direction. In this embodiment, the claw washer 31 can expand the clearance of the slit 31*a* by the wedge effect of the wedge-shaped member 34*b* of the bush 34.

Figure 11:
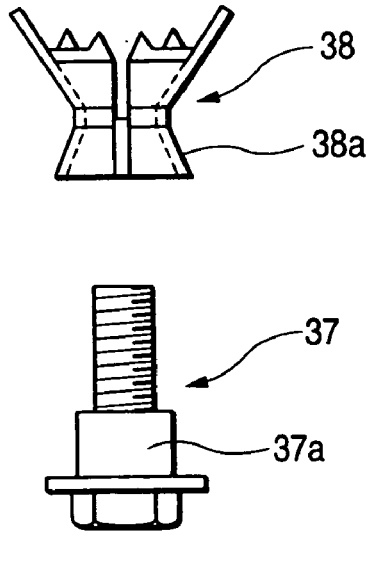
FIG. 11 is a side view of a claw washer and a bolt in an antenna mounting structure according to a fifth embodiment of the invention.

FIG. 11 shows a fifth embodiment of the invention. In this embodiment, a claw washer 38 is provided with a truncated cone-shaped portion 38*a* in which an inner diameter is increased downward. An bolt 37 is provided with a cylindrical member 37*a* having a slightly smaller outer diameter than the lower inner diameter of the truncated cone-shaped portion 38*a*. In this embodiment, the cylindrical member 37*a* abuts on an inner face of the truncated cone-shaped portion 38*a* by screwing and fastening the bolt 37, thereby expanding the claw washer 38.

Next, a sixth embodiment of the invention will be described with reference to FIGS. 12A through 158.

Figure 12A:
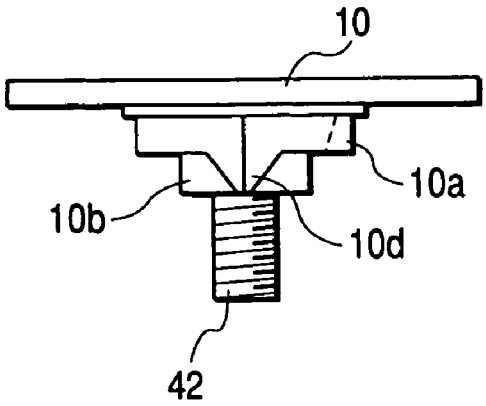
FIG. 12A is a front view of an antenna base in an antenna mounting structure according to a sixth embodiment of the invention.
Figure 12B:
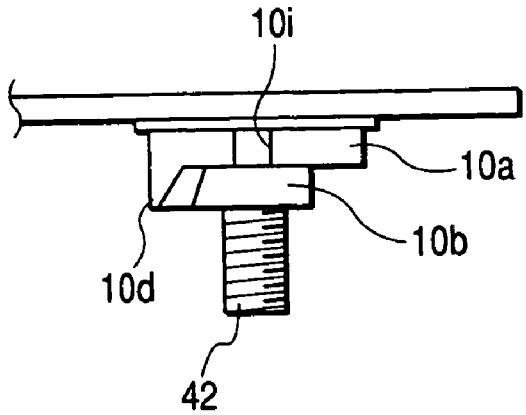
FIG. 12B is a side view of the antenna base of FIG. 12A.
Figure 13A:
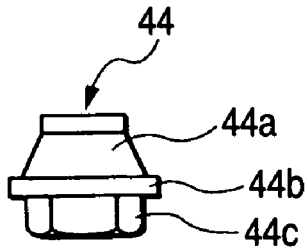
FIG. 13A is a side view of a nut fitted with the antenna base of FIG. 12A.
Figure 13B:
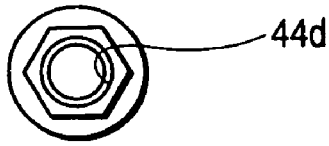
FIG. 13B is a bottom view of the nut of FIG. 13A.

As shown in FIGS. 12A and 12B, an antenna base 10 in this embodiment is different from the antenna base 10 in the first embodiment in that a bolt 42 is protruded downward from the antenna base 10 in place of the threading of the female screw 10*c*. A nut 44 shown in FIGS. 13A and 13B is constituted by a hexagonal head portion 44*c*, a flange portion 44*b* and a truncated-conical portion 44*a*, and a female screw 44*d* capable of being screwed into the bolt 42 is threaded on a center of truncated-conical portion 44*a*. The truncated-conical portion 44*a* of the nut 44 has an upper outer diameter which is set to be smaller than a lower inner diameter of a claw washer 18 and a lower outer diameter which is set to be larger than the lower inner diameter of the daw washer 18. In this embodiment, the same claw washer 18 as that in the first embodiment is used.

Figure 14:
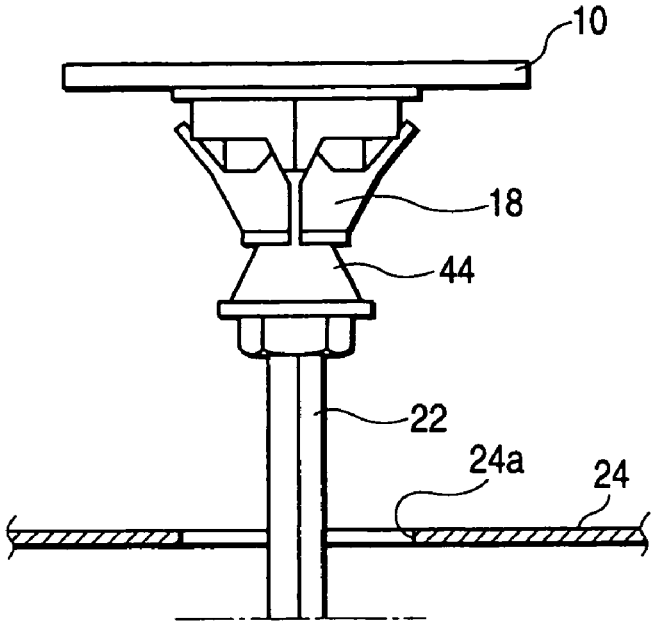
FIG. 14 is a side view showing a state before the antenna base of FIG. 12A is provisionally fixed on a vehicle body.
Figure 15A:
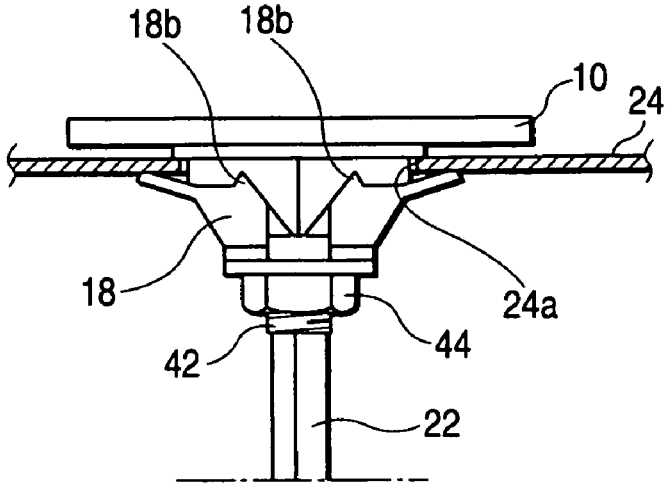
FIG. 15A is a side view showing a state that the antenna base of FIG. 12A is plenarily fixed on the vehicle body.
Figure 15B:
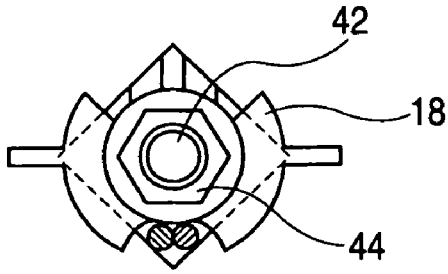
FIG. 15B is a bottom plan view showing the state of FIG. 15A.

The claw washer 18 and the nut 44 are assembled into the antenna base 10 and they are integrated with each other, and a cable 22 is inserted through a hole 24*a* of a roof panel or the like from above as shown in FIG. 14 and they are strongly pressed downward in this state. Consequently, provisional fixation claws 18*d* of the claw washer 18 are elastically deformed and are thus permitted to be inserted, and are elastically returned after a passage through the hole 24*a* so that an upward slip-off from the hole 24*a* can be prevented to establish a provisional fixation state. When the nut 44 protruded downward is strongly fastened, the diameter of the claw washer 18 is greatly changed so that claws 18*b* cut into the peripheral edge portion of the hole 24*a* on the back side of the roof panel or the like as shown in FIG. 15. The claw washer 18 is thus fixed on the roof panel or the like while establishing electrical connection therebetween.

Also in this embodiment, various mechanisms for expanding the slit of the claw washer 18 as explained in the fourth and fifth embodiments may be properly adopted. Further, variations as explained in the second and third embodiments may be adopted. That is, the head portion 44*c* of the nut 44 may be omitted and a hexagonal bottomed hole may be provided. Further, the head portion 44*c* and the truncated-conical portion 44*a* in the nut 44 may be provided as separate members.

In the above embodiments, two provisional fixation claws 18*d* are provided. However, the number of the provisional fixation claws 18*d* may be more than two. In the above embodiments, the hole 24*a* formed on the roof panel or the like is shaped into square. However, the shape of the hole 24*a* may be circular or oval. In this case, the shape of the protrusion 10*a* of the antenna base 10 is properly changed so as to correspond to the shape of the hole 24*a*. In the above embodiments, the claws 18*b* are cut into the back face of the roof panel or the like to establish the electric connection therebetween. However, if it is not necessary to establish the electric connection, or any other member for establish the electric connection is provided, the claw washer 18 may not be a conductive member. In this case, the claw washer 18 may be made of any materials capable of being deformed elastically or plastically.

Figure 16:
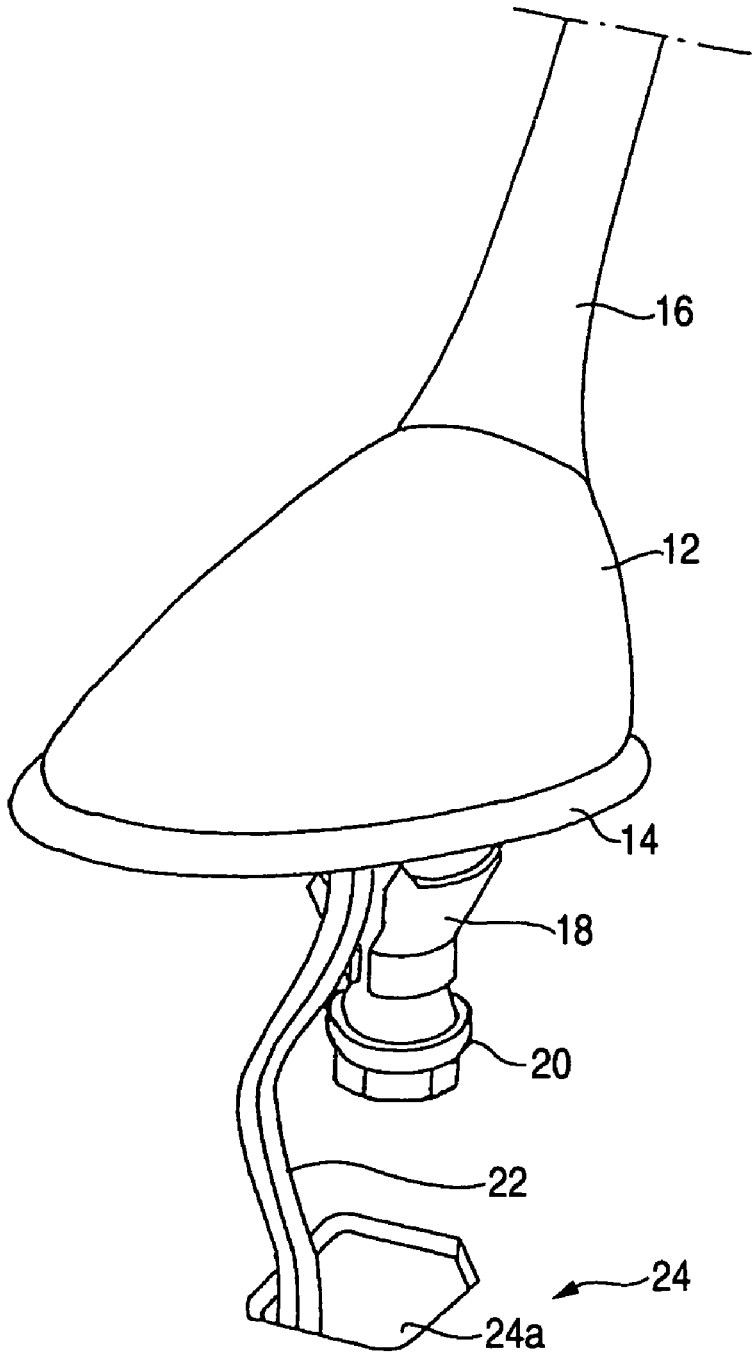
FIG. 16 is a perspective view of an antenna according to a seventh embodiment of the invention.
Figure 17A:
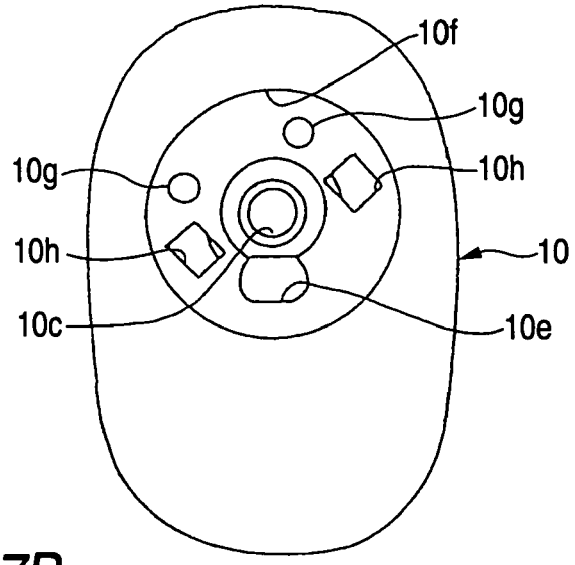
FIG. 17A is a top view of an antenna base in the antenna of FIG. 1.
Figure 17B:
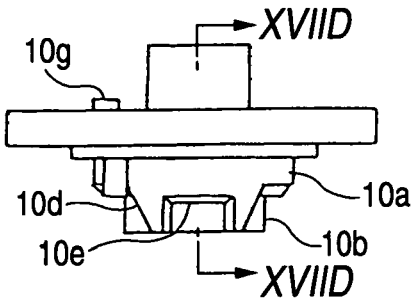
FIG. 17B is a side view of the antenna base of FIG. 2A.
Figure 17D:
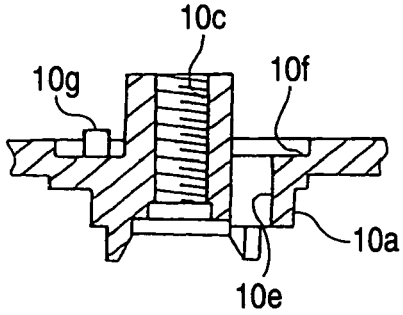
FIG. 17D is a section view taken along a line XVIID-XVIID in FIG. 2B.
Figure 17C:
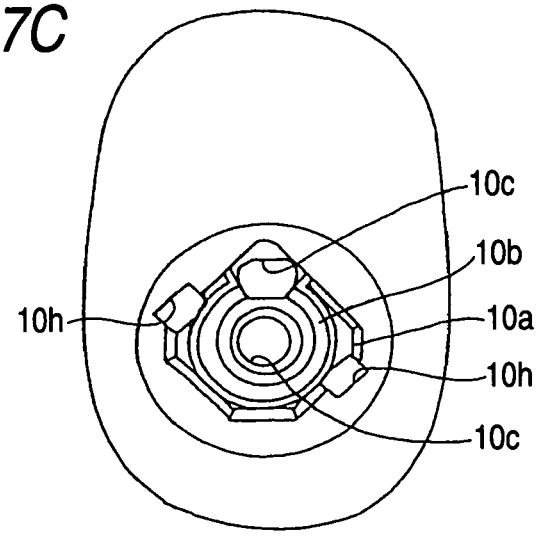
FIG. 17C is a bottom view of the antenna base of FIG. 2A.
Figure 18A:
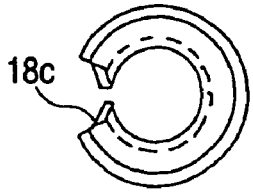
FIG. 18A is a top view of a claw washer in the antenna of FIG. 1.
Figure 18B:
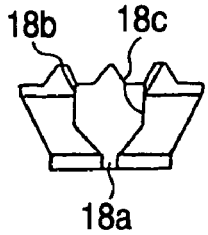
FIG. 18B is a front view of the claw washer of FIG. 3A.
Figure 18C:
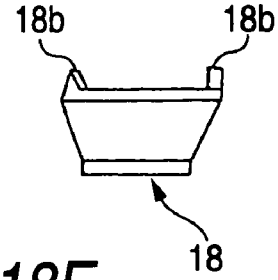
FIG. 18C is a side view of the claw washer of FIG. 3A.
Figure 18D:
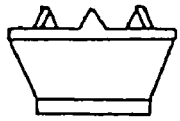
FIG. 18D is a rear view of the claw washer of FIG. 3A.
Figure 18E:
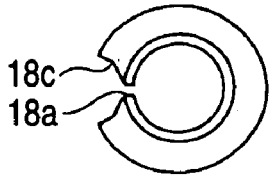
FIG. 18E is a bottom view of the claw washer of FIG. 3A.

FIG. 16 shows a vehicle antenna according to a seventh embodiment of the invention, wherein an antenna base 10 is appropriately fixed in place within a housing 12, and a rubber pad 14 is provided on a lower face side of the antenna base 10. A proximal end portion of an antenna element 16 is fixed to an upper end portion of the housing 12, and a circuit board (not shown) which includes an amplifier circuit is appropriately accommodated within the housing 12. A bolt 20, on which a claw washer 18 is fitted, is screwed into the antenna base 10 at a distal end thereof from therebelow so as to be integrated into the antenna base 10. A cable 22, which constitutes a signal transmission path or the like, is let out of the antenna base 10.

The vehicle antenna configured as has been described above is inserted into a hole 24*a* opened in a roof or the like of a vehicle body 24 from thereabove with the cable 22 and the bolt 20 and the claw washer 18 passed through the hole 24*a* first, whereby the vehicle antenna is provisionally fixed to the vehicle body 24 (described later in detail). Furthermore, the bolt 20 that projects into an inside of the vehicle is fastened so that the vehicle antenna is fixed to the vehicle body 24 while an electric conductivity is secured.

As shown in FIGS. 17A to 17D, the antenna base 10 formed of metal comprises: a protrusion 10*a*, which is formed substantially into a square shape in plan view, is provided on a bottom face of the antenna base 10; a cylindrical portion 10*b*, provided at the center of the protrusion 10*a*; and an internal thread 10*c* engraved within the cylindrical portion 10*b*. A wedge-shaped member 10*d*, which gets narrower as it extends downwards, is formed in such a manner as to extend from a corner of the substantially square protrusion 10*a* to a circumferential face of the cylindrical portion 10*b*. A cable hole 10*e*, through which the cable is to be passed, is opened in the wedge-shaped member 10*d* so as to form a through hole which penetrates through the antenna base 10 in a vertical direction. A recess 10*f* is provided on an upper face of the antenna base 10 for accommodating therein a provisional holder 26 (described layer), and bosses 10*g* are provided on the upper face of the antenna base 10 to be used to clamp the provisional holder 26 within the recess 10*f*. Holes 10*h* are opened in the upper face of the antenna base 10 in such a manner as to vertically penetrate through the antenna base 10 so as to allow the passage of claws 26*a* (described later) of the provisional holder 26 therethrough.

As shown in FIGS. 18A to 18E, the claw washer 18 made of a sheet of metal is formed substantially into a truncated conical shape which gets narrower as it extends downwards. The claw washer 18 is partially cut to thereby form a slit 18*a* therein so as to be formed substantially into a C-shape as viewed from a top thereof. Then, three claws 18*b* are provided on an upper edge portion of the claw washer 18 in such a manner as to project upwards therefrom. Furthermore, a notch 18*c* is continuously formed with the slit 18*a* so that the wedge-shaped member 10*d* is inserted thereinto and the cable 22 is allowed to escape thereto. An outer diameter of the upper edge portion of the claw washer 18 including the claws 18*b* is set so as to pass through the hole 24*a*.

Figure 19A:
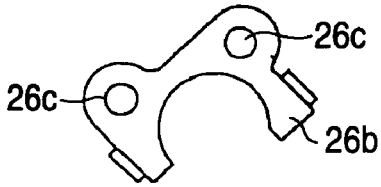
FIG. 19A is a top view of a provisional holder in the antenna of FIG. 1.
Figure 19B:
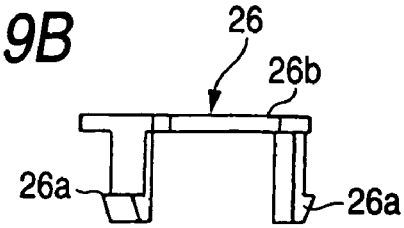
FIG. 19B is a side view of the provisional holder of FIG. 19A.

As shown in FIGS. 19A and 19B, the provisional holder 26 formed of elastic resin material comprises claws 26*a* extended from an upper connecting portion 26*b*. Opened in this connecting portion 26*b* are holes 26*c* into which the bosses 10*g* of the antenna base 10 are inserted to thereby be clamped.

Figure 20:
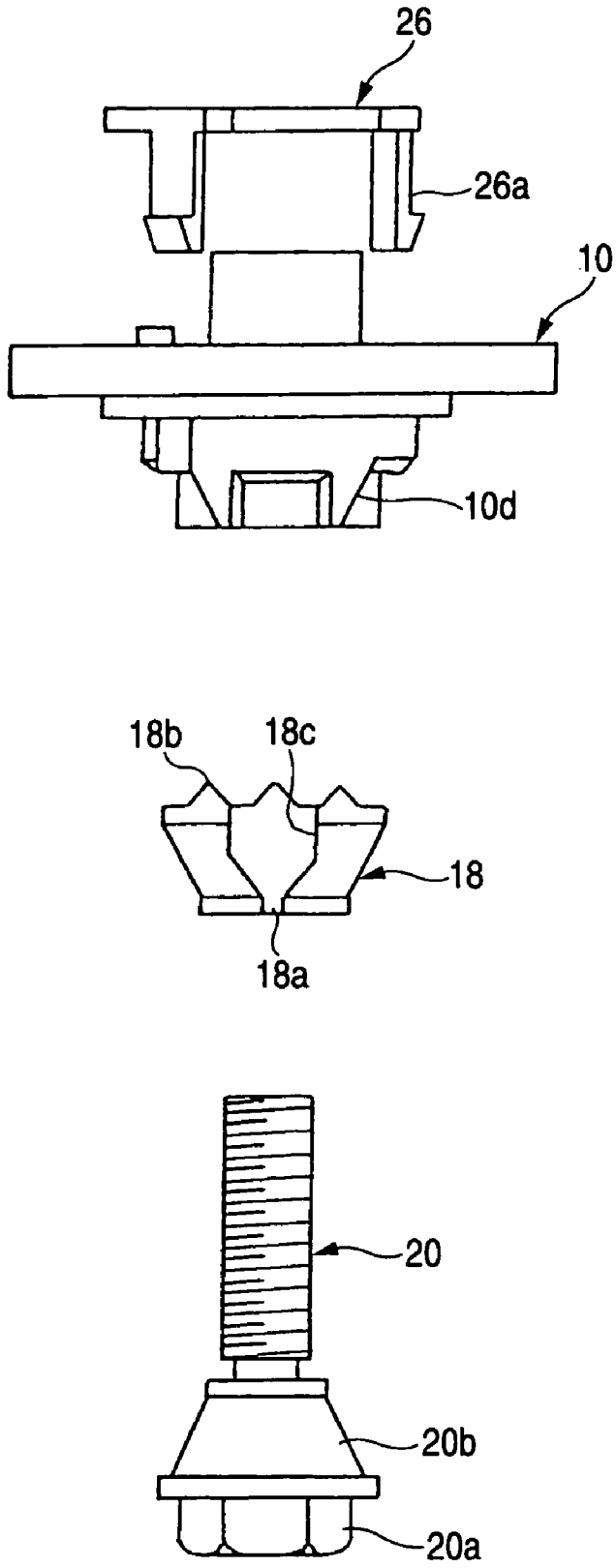
FIG. 20 is a side view showing members constituting a mounting structure for the antenna of FIG. 1.

As shown in FIG. 20, the bolt 20 formed of metal includes a head portion 20*a* of a hexagonal shape when viewed from a bottom thereof, and a truncated-conical portion 20*b* is formed on a bolt side of the head portion 20*a*. This truncated-conical portion 20*b* is configured so as to become wider from an upper end to a lower end thereof in such a manner that an upper outer diameter is slightly smaller while a lower outer diameter is larger than a lower inner diameter of the claw washer 18 in an original state.

The assembly of the respective members that have been described heretofore is implemented in such an arrangement as shown in FIG. 20. Firstly, the provisional holder 26 is assembled on to the antenna base 10 from thereabove and is fixed thereto by being clamped appropriately. Furthermore, a distal end portion of the bolt 20 on which the claw washer 18 is fitted is screwed into the internal thread 10*c* in the antenna base 10 from therebelow to a slight extent, whereby the bolt 20 and the claw washer 18 are integrated on to the antenna base 10. In implementing the assembly, the claw washer 18 is provided to realize such a positional relationship that the notch 18*c* therein is made to oppositely face the wedge-shaped member 10*d* of the antenna base 10 so that the wedge-shaped member 10*d* can be inserted into the notch 18*c*.

Figure 21A:
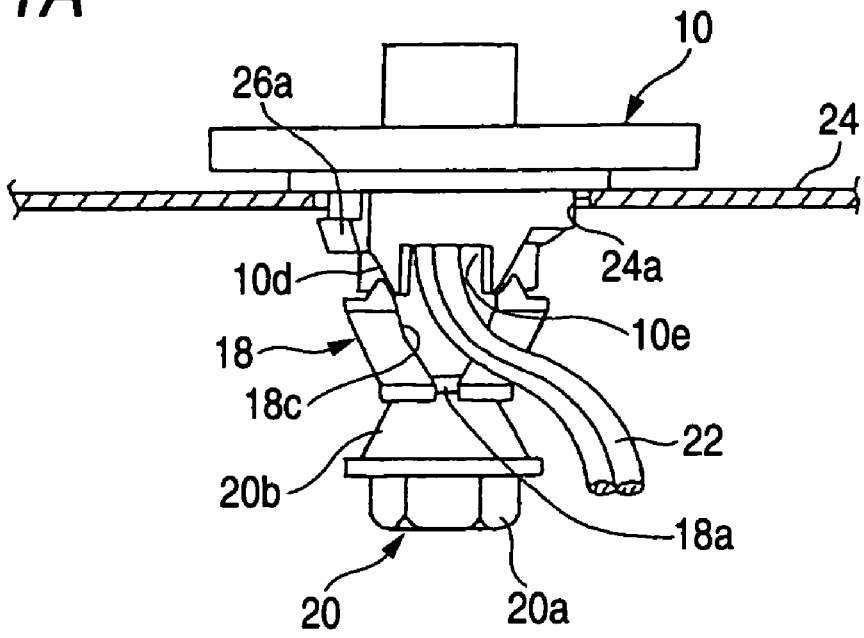
FIG. 21A is a partially sectional side view showing a state that the antenna of FIG. 1 is provisionally fixed on a vehicle body.
Figure 21B:
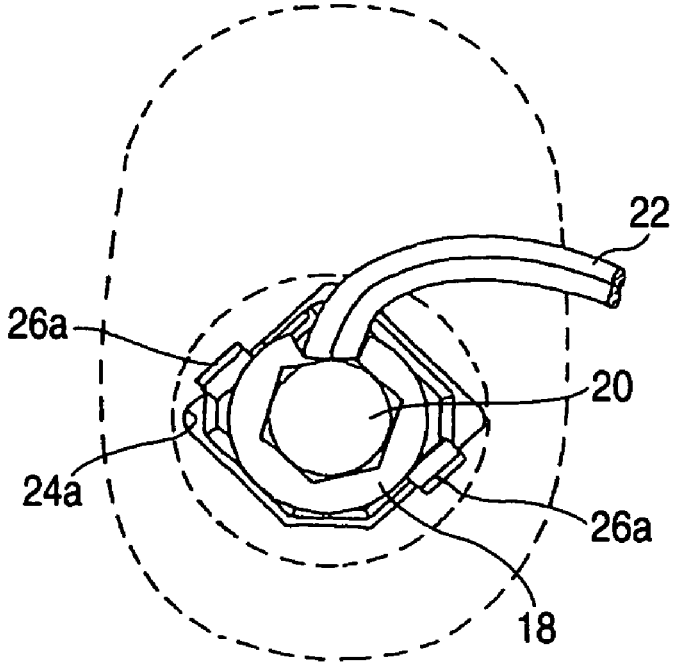
FIG. 21B is a schematic bottom view showing the state of FIG. 21A.

In such an integrated state, as shown in FIGS. 21A and 21B, the cable 22 is firstly passed through the cable hole 10*e* in the antenna base 10 and is then inserted into the hole 24*a* in the vehicle body 24 from thereabove. Furthermore, the protrusion 10*a* of the antenna base 10 is made to face the hole 24*a* which is formed substantially into a square shape. The substantially square shape of the hole 24*a* is slightly larger than the substantially square shape of the protrusion 10*a*. Then, the bolt 20 and the claw washer 18 are inserted into the hole 24*a* from thereabove, the claws 26*a* of the provisional holder 26 elastically deform so as to be allowed to be inserted into the hole 24*a*, and after having passed through the hole 24*a*, the claws 26*a* elastically restore, whereby the hook portions at distal ends thereof are positioned at the circumferential edge portion of the hole 24*a* to thereby be caught thereon. In the state shown in FIGS. 21A and 21B, the antenna base 10 is prevented from being dislodged upwards by the claws 26*a*, whereby the antenna base 10 is provisionally fixed to the hole 24*a*.

Figure 22A:
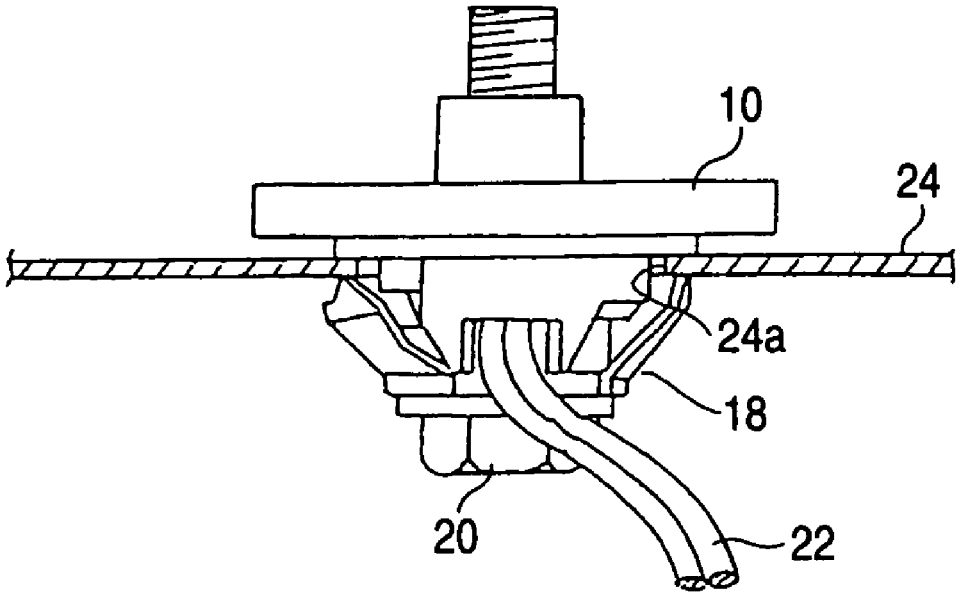
FIG. 22A is a partially sectional side view showing a state that the antenna of FIG. 1 is plenarily fixed on the vehicle body.
Figure 22B:
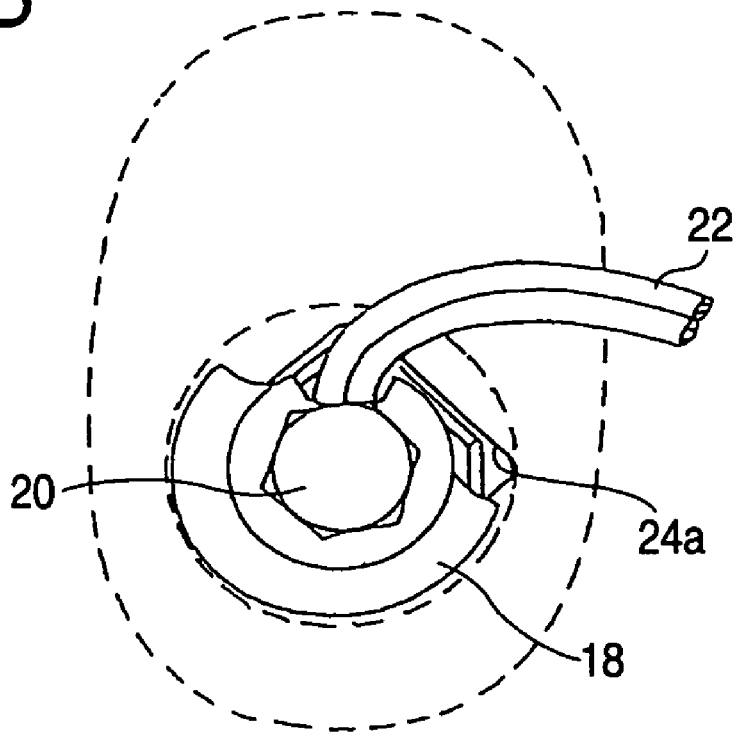
FIG. 22B is a schematic bottom view showing the state of FIG. 22A.
Figure 23A:
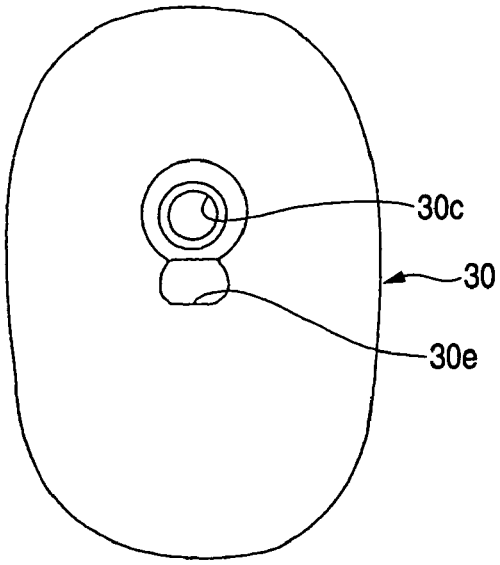
FIG. 23A is a top view of an antenna base in an antenna according to an eighth embodiment of the invention.
Figure 23D:
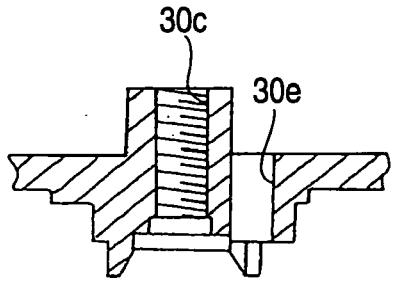
FIG. 23D is a section view taken along a line XXIIID-XXIIID in FIG. 23B.
Figure 23B:
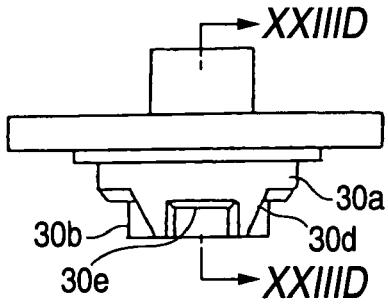
FIG. 23B is a side view of the antenna base of FIG. 23A.
Figure 23C:
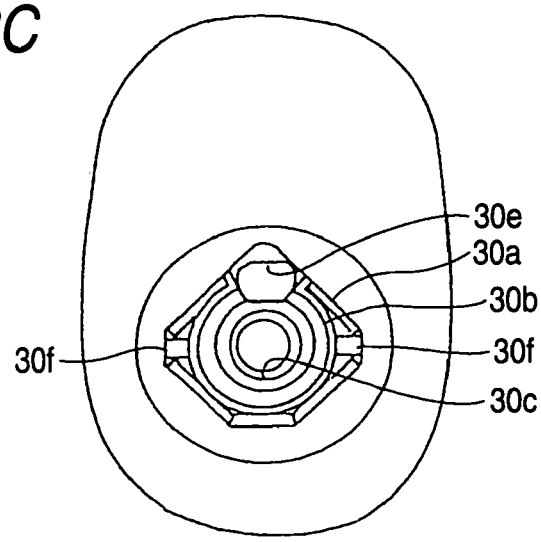
FIG. 23C is a bottom view of the antenna base of FIG. 23A.
Figure 24A:
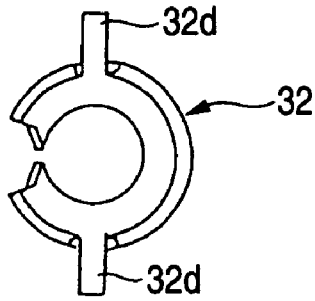
FIG. 24A is a top view of a claw washer in the antenna of FIG. 23A.
Figure 24B:
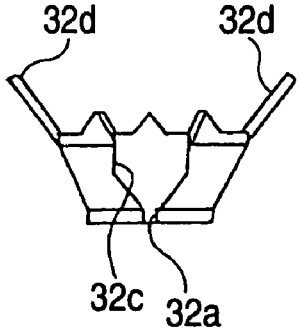
FIG. 24B is a front view of the claw washer of FIG. 24A.
Figure 24C:
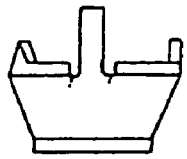
FIG. 24C is a side view of the claw washer of FIG. 24A.
Figure 24D:
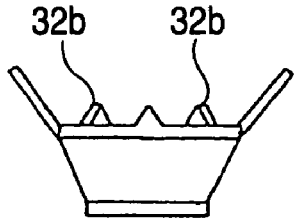
FIG. 24D is a rear view of the claw washer of FIG. 24A.
Figure 24E:
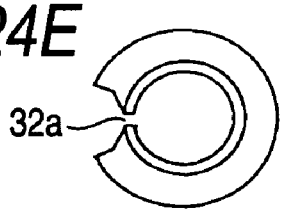
FIG. 24E is a bottom view of the claw washer of FIG. 24A.

Then, as shown in FIGS. 22A and 22B, the bolt 20 is screwed strongly into the internal thread 10*c* in the antenna base 10, and the claw washer 18 is deformed by the wedge-shaped member 10*d* of the antenna base 10 and the truncated-conical portion 20*b* of the bolt 20 in such a manner that the diameter of the substantially C-shape thereof is increased, whereby the claw washer 18 is opened further. Then, the outer diameter of the three claws 18*b* on the upper edge portion of the claw washer 18 is increased so as to be larger than the diametrical dimension of the hole 24*a*, whereby the claws 18*b* are positioned at the circumferential edge portion of the hole 24*a*. Furthermore, by continuing to tighten the bolt 20 strongly, the claws 18*b* are made to bite into the inner face of the vehicle body 24, whereby the antenna base 10 is fixed to the vehicle body 24, and an electrical conduction is established in the vehicle body 24 via the bolt 20 and the claw washer 18.

Here, during the operation of expanding the diameter of the substantially C-shape of the claw washer 18, friction force causes a force to act on the claw washer 18 which attempts to rotate the washer 18 around an axis thereof together with the bolt 20 in conjunction with the rotational tightening of the bolt 20. However, since one end of the slit 18*a* in the claw washer 18 is in abutment with the wedge-shaped member 10*d* of the antenna base 10 to thereby be restricted in position, only the other end of the slit 18*a* is expanded in the direction in which the claw washer 18 is attempted to be rotated together with the bolt 20, whereby the notch 18*c* of the slit 18*a* is also expanded. Then, the cable 22, which is passed through the cable hole 10*e* provided in the central portion of the wedge-shaped member 10*d*, is surely kept remaining within the notch 18*c*, so as to be prevented from being brought into abutment with the claw washer 18, thereby making it possible to prevent the cable 22 from being damaged.

In the seventh embodiment, the cable hole 10*e* through which the cable 22 is passed is provided in the wedge-shaped member 10*d* of the antenna base 10. However, an appropriate notch through which the cable 22 is passed may be provided in the wedge-shaped member 10*d* of the antenna base 10 instead of the cable hole 10*e*.

In the seventh embodiment, the claws 26*a* of the provisional holder 26 are inserted into the hole 24*a* so as to be hooked on the circumferential edge portion of the hole 24*a*. However, holes may be opened separately from the hole 24*a* opened in the vehicle body 24 so that the claws 26*a* are inserted to be caught therein.

Next, an eighth embodiment of the invention will be described with reference to FIGS. 23A to 27B. Components similar to those in the seventh embodiment will be designated by the same reference numerals and repetitive explanations for those will be omitted.

In the eighth embodiment, what is largely different from the seventh embodiment resides in a temporarily fixing structure. As shown in FIGS. 23A to 23D, an antenna base 30 formed of metal comprises: a protrusion 30*a*, which is formed substantially into a square shape as viewed from a top thereof, and is provided on a bottom face of the antenna base 30; a cylindrical portion 30*b*, which is provided at the center of the protrusion 30*a*; and an internal thread 30*c*, which is engraved within the cylindrical portion 30*b*. A wedge-shaped member 30*d*, which gets narrower as it extends downwards, is formed in such a manner as to extend from a corner of the substantially square protrusion 30*a* to a circumferential face of the cylindrical portion 30*b*. A cable hole 30*e*, through which the cable is to be passed, is opened in the wedgeshaped member 30*d* so as to form a through hole which penetrates through the antenna base 30 in a vertical direction. Grooves 30*f* are provided at two corners of the substantially square protrusion 30*a* where the wedge-shaped member 30*d* is not provided, for receiving an elastic deformation of claws 32*d* of a claw washer 32 (described later). There is no structure corresponding to the recess 10*f*, the bosses 10*g* and the holes 10*h* which are provided in the seventh embodiment.

As shown in FIGS. 24A to 24E, the claw washer 32 is made of a sheet of elastic conductive metal and formed substantially into a truncated conical shape which gets narrower as it extends downwards. The claw washer 32 is partially cut to thereby form a slit 32*a* therein so as to be formed substantially into a C-shape as viewed from a top thereof. Then, three claws 32*b* are provided on an upper edge portion of the claw washer 18 in such a manner as to project upwards therefrom. An outer diameter of the upper edge portion of the claw washer 32 including the claws 32*b* is set is set so as to pass through the hole 24*a*. A notch 32*c* is continuously formed with the slit 32*a* so that the wedge-shaped member 30*d* is inserted thereinto and the cable 22 is allowed to escape thereto. Two claws 32*d* are provided on the upper edge portion of the claw washer 32 at oppositely facing positions which are 90° apart in clockwise and counterclockwise directions from the slit 32*a* as viewed from the top thereof in such a manner as to project upwards from the upper edge portion so as to be gradually spaced apart from each other as they extend upwards. The claws 32*d* are made longer than the claws 32*b*, and a distance between distal ends thereof becomes larger than the outer diameter of the upper edge portion of the claw washer 32 including the claws 32*b*.

Figure 25:
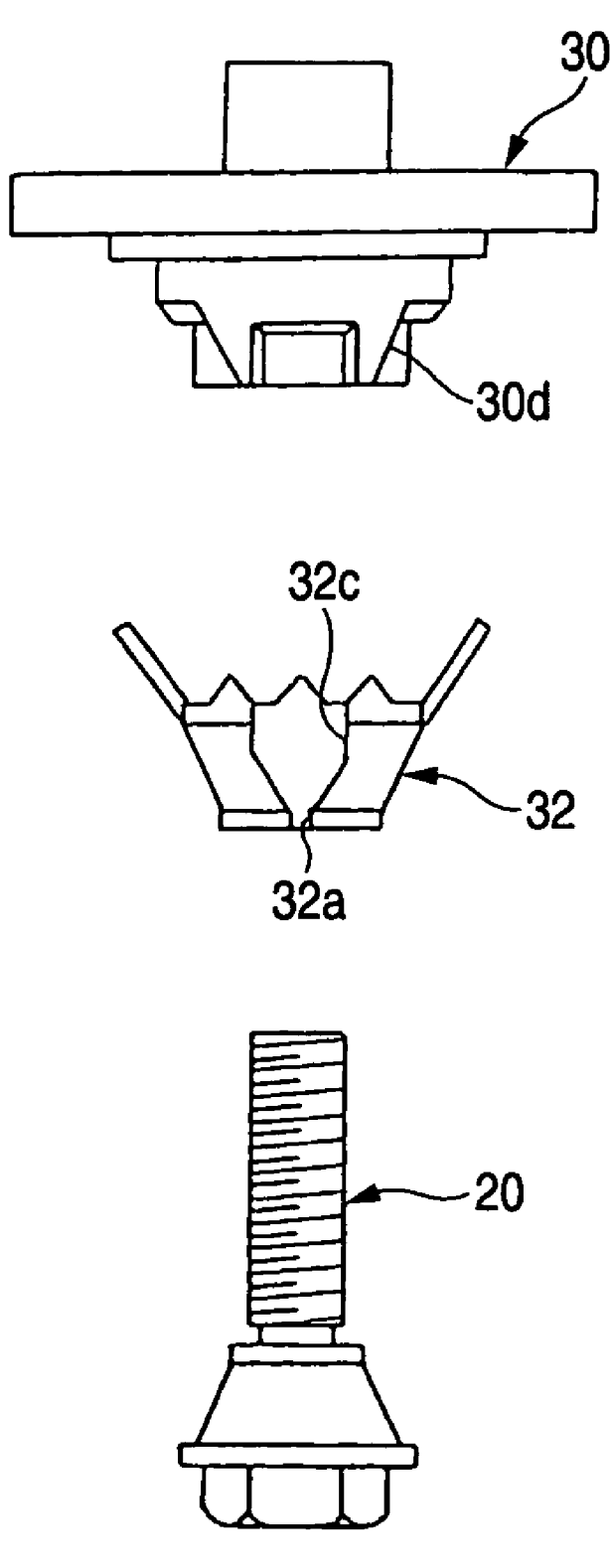
FIG. 25 is a side view showing members constituting a mounting structure for the antenna of FIG. 23A.

Then, as shown in FIG. 25, a distal end portion of the bolt 20 on which the claw washer 32 is fitted is screwed into the antenna base 30 from therebelow, whereby the bolt 20 and the claw washer 32 are integrated on to the antenna base 20. As this occurs, the antenna base 30, the bolt 20 and the claw washer 30 are disposed in a positional relationship in which the notch 32*c* in the claw washer 32 faces the wedge-shaped member 30*d* of the antenna base 30.

Figure 26A:
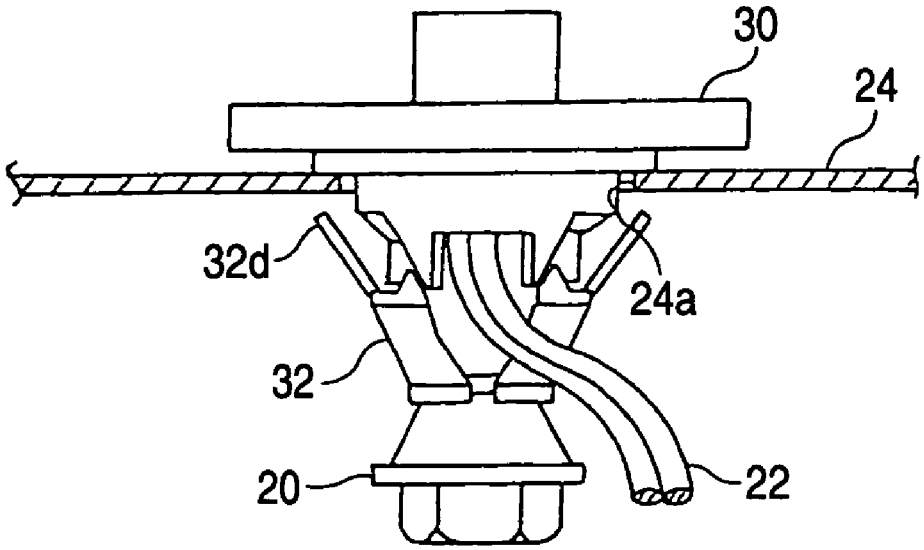
FIG. 26A is a partially sectional side view showing a state that the antenna of FIG. 23A is provisionally fixed on a vehicle body.
Figure 26B:
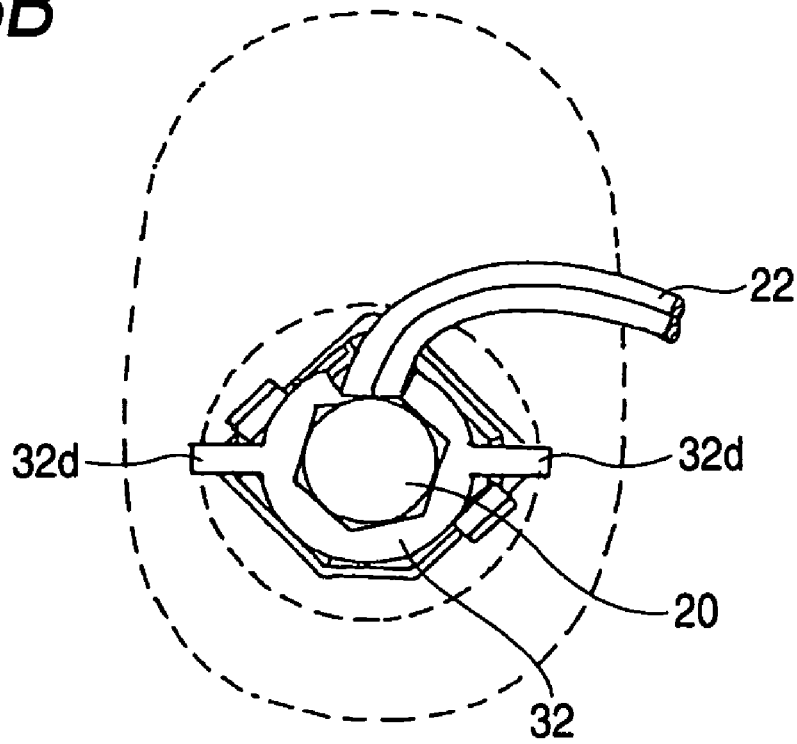
FIG. 26B is a schematic bottom view showing the state of FIG. 26A.

In such an integrated state, as shown in FIGS. 26A and 26B, the cable 22 is firstly passed through the cable hole 30*e* in the antenna base 30 and is then inserted into the hole 24*a* in the vehicle body 24 from thereabove. Furthermore, the protrusion 30*a* of the antenna base 30 is made to face the hole 24*a*. Then, when the bolt 20 and the claw washer 32 are inserted into the hole 24*a* from thereabove, the claws 32*d* of the claw washer 32 elastically deform so as to be allowed to be inserted into the hole 24*a*, and after having passed through the hole 24*a*, the claws 32*d* elastically restore, whereby the distal ends thereof are positioned at the inner face of the circumferential edge portion of the hole 24*a*. In the state shown in FIGS. 26A and 26B, the antenna base 30 is prevented from being dislodged upwards by the claws 32*d*, whereby the antenna base 30 is provisionally fixed to the hole 24*a*. When the claws 32*d* pass through the hole 24*a*, the claws 32*d* are inserted into the grooves 30*f* on the antenna base 30 to thereby permit an elastic deformation thereof in a direction in which the outer diameter thereof is reduced.

Figure 27A:
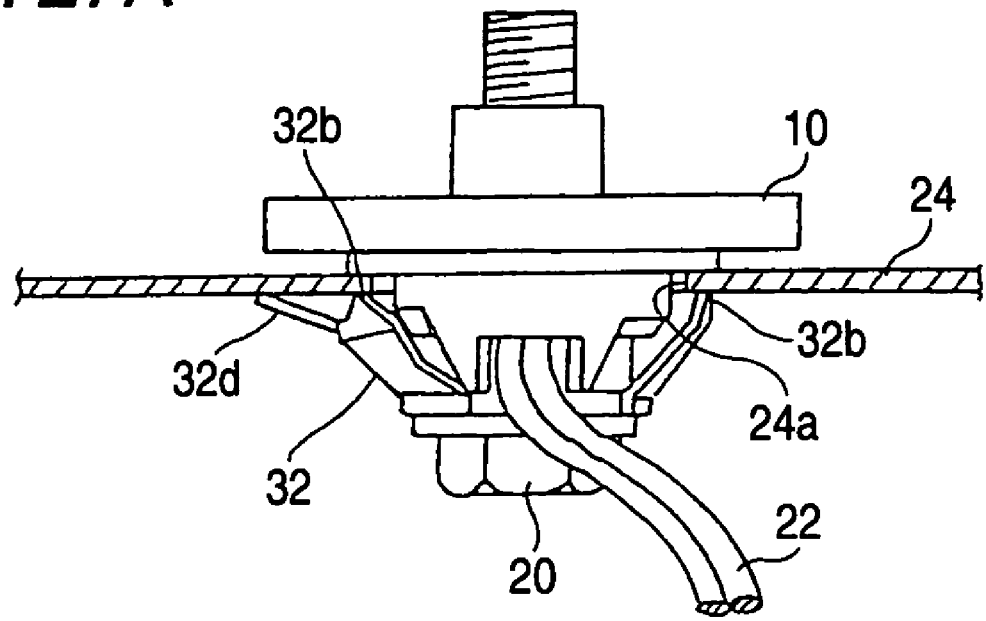
FIG. 27A is a partially sectional side view showing a state that the antenna of FIG. 23A is plenarily fixed on the vehicle body.
Figure 27B:
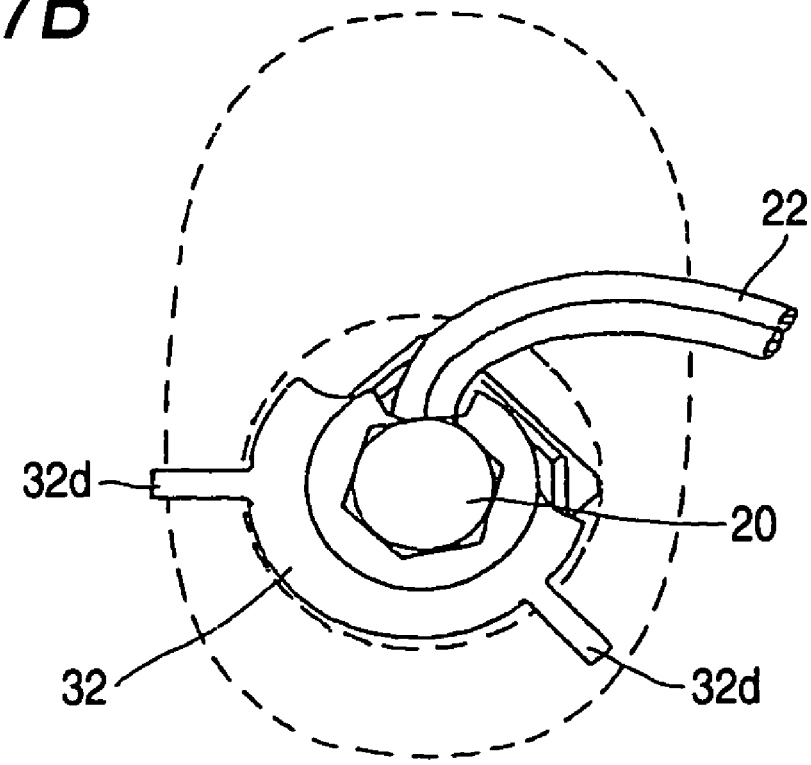
FIG. 27B is a schematic bottom view showing the state of FIG. 27A.

Then, as shown in FIGS. 27A and 27B, the bolt 20 is screwed strongly into the internal thread 30*c* in the antenna base 30, the claw washer 32 is opened by the wedge-shaped member 30*d* of the antenna base 30 and the truncated-conical portion 20*b* of the bolt 20 in such a manner that the diameter of the substantially C-shape thereof is increased, whereby the outer diameter of the three claws 32*b* on the upper edge portion of the claw washer 32 is increased, and the claws 32*b* are positioned at the circumferential edge portion of the hole 24*a*. By continuing to tighten the bolt 20 strongly, the claws 32*b* are made to bite into the inner face of the vehicle body 24, whereby the antenna base 30 is fixed to the vehicle body 24, and an electrical conduction is established in the vehicle body 24 via the bolt 20 and the claw washer 32. Then, as to the enlargement of the diameter of the substantially C-shaped claw washer 32, as with the seventh embodiment, since one end of the slit 32*a* in the claw washer 32 is restricted in position, only the other end of the slit 32*a* is expanded in a direction in which the claw washer 32 is attempted to be rotated together with the bolt 20 to thereby expand the notch 32*c*. Here, since the cable 22 which is passed through the cable hole 30*e* formed at the central portion of the wedge-shaped member 30*d* is allowed to surely stay within the notch 32*c*, the cable 22 can be prevented from being damaged.

Figure 28A:
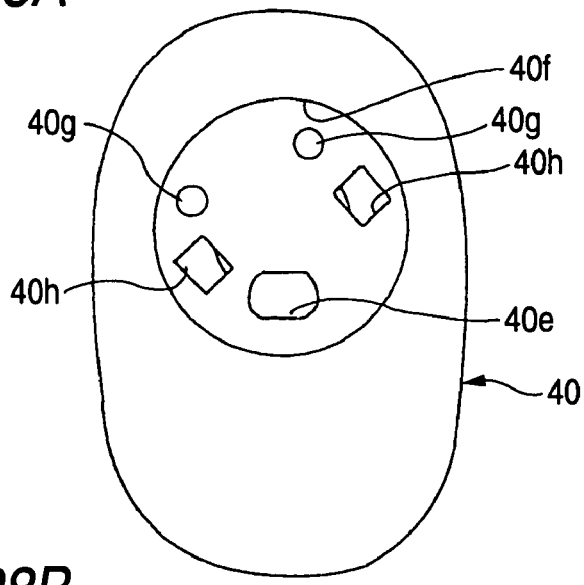
FIG. 28A is a top view of an antenna base in an antenna according to a ninth embodiment of the invention.
Figure 28B:
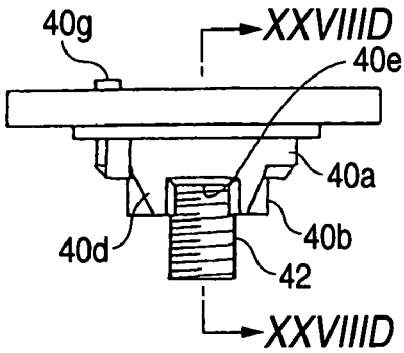
FIG. 28B is a side view of the antenna base of FIG. 28A.
Figure 28D:
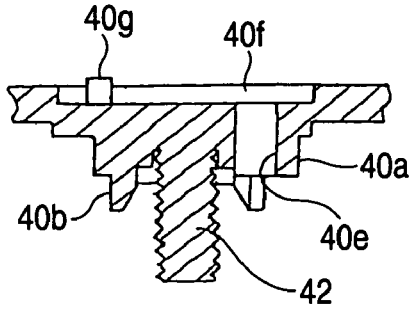
FIG. 28D is a section view taken along a line XXVIIID-XXVIIID in FIG. 28B.
Figure 28C:
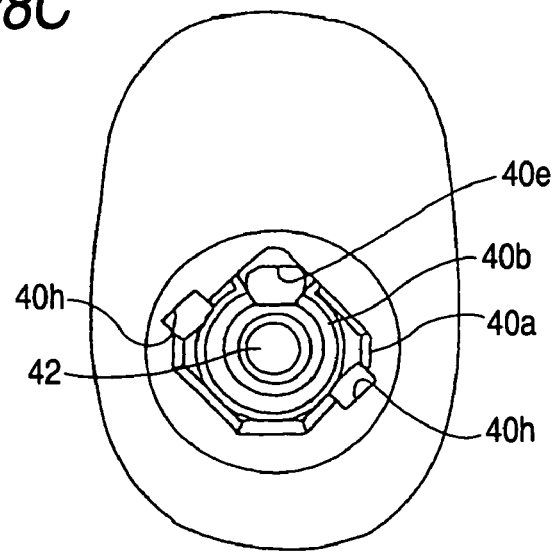
FIG. 28C is a bottom view of the antenna base of FIG. 28A.

Next, a ninth embodiment of the invention will be described with reference to FIGS. 28A to 29. Components similar to those in the seventh embodiment will be designated by the same reference numerals and repetitive explanations for those will be omitted.

In the ninth embodiment, what is largely different from the seventh embodiment resides in that a bolt is integrally provided on an antenna base in such a manner as to project therefrom. As shown in FIGS. 28A to 28D, a bolt 42 is integrally provided on an antenna base 40 in such a manner as to project downwards therefrom, in place of the internal thread 10*c* provided in the antenna base 10 in the seventh embodiment. As to the other components, as with the seventh embodiment, there are provided a protrusion 40*a*, a cylindrical portion 40*b*, a wedge-shaped member 40*d*, a cable hole 40*e*, a recess 40*f*, bosses 40*g* and holes 40*h*.

Figure 29:
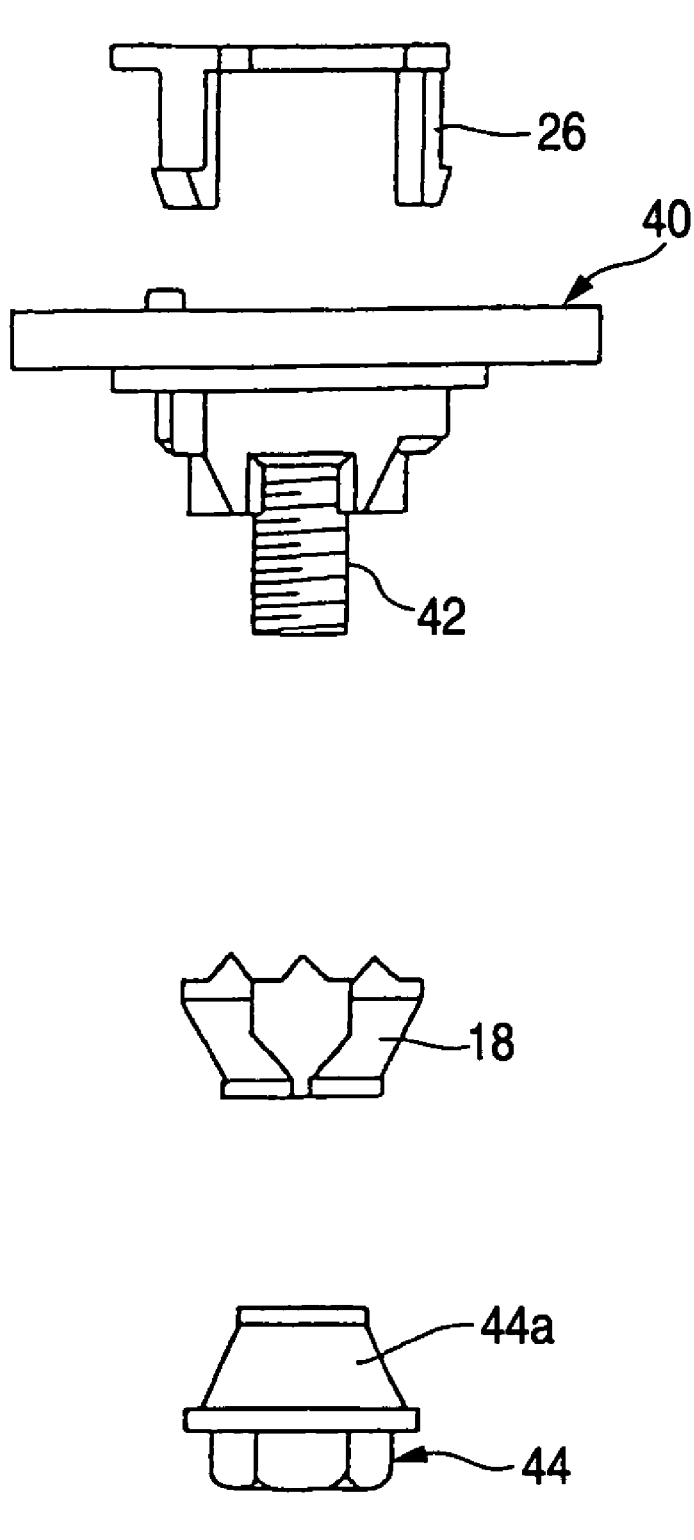
FIG. 29 is a side view showing members constituting a mounting structure for the antenna of FIG. 28A.

As shown in FIG. 29, a nut 44 which is screwed on the bolt 42 is formed of metal and includes a truncated-conical portion 44*a* which is formed to become wider as it extends from an upper end to a lower end thereof in such a manner that an upper outer diameter is smaller while a lower outer diameter thereof is larger than a lower inner diameter of the claw washer 18.

Then, the respective members are arranged as shown in FIG. 29, and the provisional holder 26 is assembled on to the antenna base 40, furthermore, the claw washer 18 is fitted on the bolt 42 so as to establish a positional relationship in which the notch 18*c* in the claw washer 18 faces the wedge-shaped member 40*d* of the antenna base 40, and the nut 44 is screwed on a lower end portion of the bolt 42, whereby the provisional holder 26, the claw washer 18 and the nut 44 are integrated on to the antenna base 40. Then, the integrated members so formed are inserted into the hole 24*a* in the vehicle body 24 from thereabove, so that the integrated members are provisionally fixed to the vehicle body 24 by the provisional holder 26. Furthermore, the nut 44 is tightened strongly, so that the antenna base 40 is fixed to the vehicle body 24 and an electric conduction is obtained.

In the ninth embodiment, the provisional fixation is designed to be attained using the provisional holder 26 formed of a resin material. However, the provisional fixation may be designed to be attained, as with the eighth embodiment, using the claws 32*d* which are provided on the claw washer 32 in place of the resin provisional holder 26.

Figure 30:
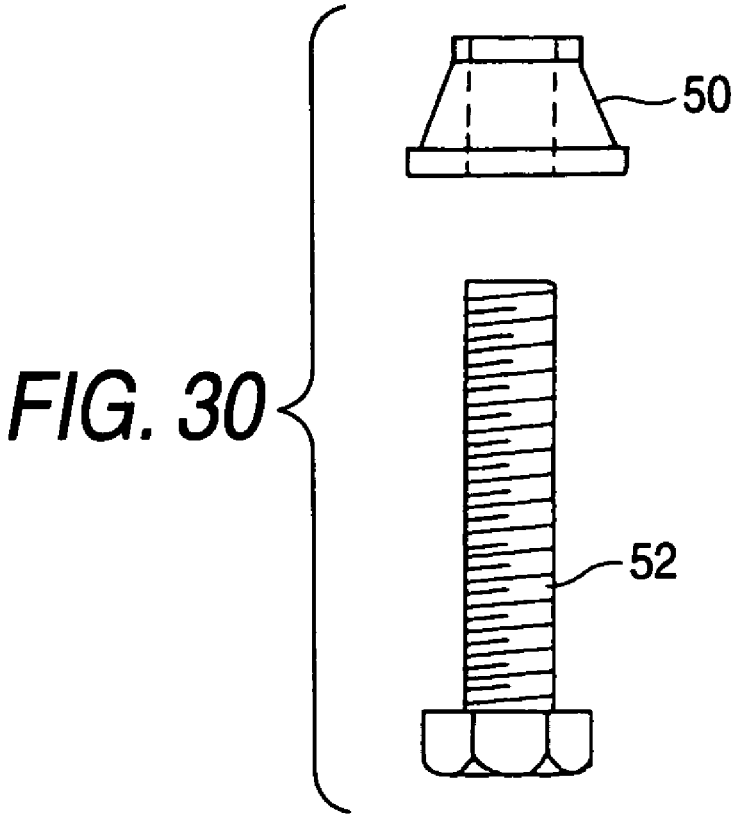
FIG. 30 is a side view showing members constituting a modified example of the mounting structure for the antenna of FIG. 1.
Figure 31:
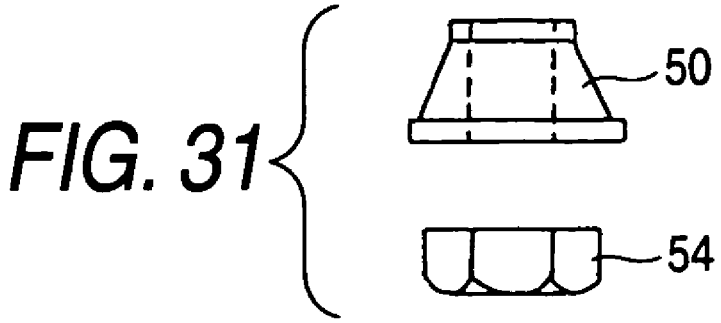
FIG. 31 is a side view showing members constituting a modified example of the mounting structure for the antenna of FIG. 28A.

In place of the bolt 20 in the seventh embodiment, a truncated-conical bush 50 may be fitted on a normal bolt 52 having a head portion as shown in FIG. 30. This bush 50 is formed to become wider as it extends from an upper end to a lower end thereof in such a manner that an upper outer diameter is smaller while a lower outer diameter thereof is larger than a lower inner diameter of the claw washer 18.

The nut 44 of the ninth embodiment may be divided into the truncated-conical bush 50 and a normal nut 54. Since the bush 50 is interposed between the claw washer 18 and the head of the bolt 52 and the bush 50 is also interposed between the claw washer 18 and the nut 54, a force acting on the claw washer 18 can be reduced which attempts to rotate the claw washer 18 around an axis thereof together with the bolt 52 and the nut 54 in conjunction with the rotation of the bolt 52 and the nut 54. Moreover, since the lower inner diameter of the claw washer 18 can be expanded by the bush 50, commercially available bolts and nuts can be used for the bolt 52 and the nut 54.

Next, a tenth embodiment of the invention will be described with reference to FIGS. 32A to 38. Components similar to those in the seventh embodiment will be designated by the same reference numerals and repetitive explanations for those will be omitted.

Figure 32A:
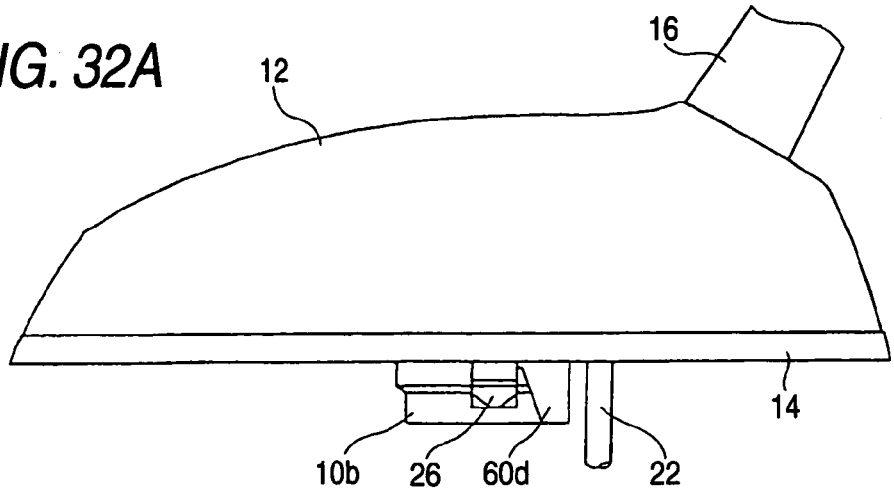
FIG. 32A is a side view of an antenna according to a tenth embodiment of the invention.
Figure 32B:
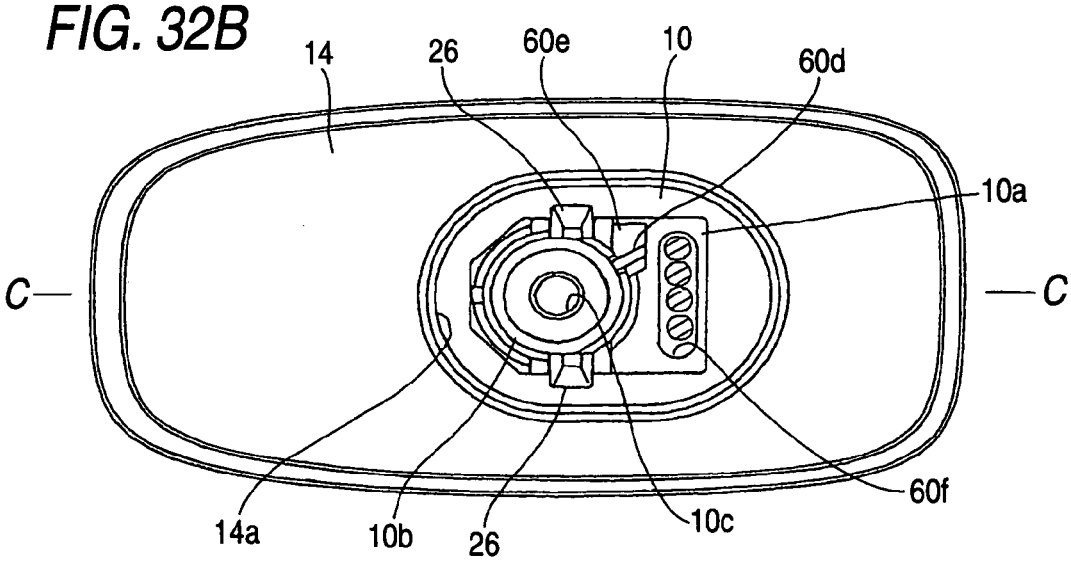
FIG. 32B is a bottom view of the antenna of FIG. 32A.
Figure 32C:
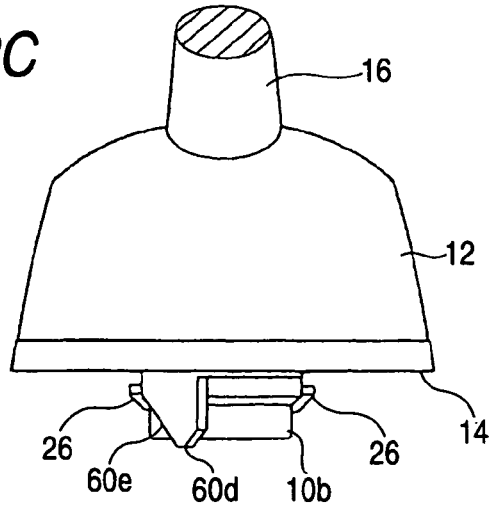
FIG. 32C is a front view of the antenna of FIG. 32A.
Figure 33:
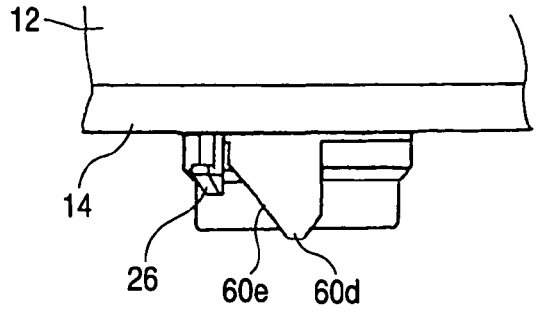
FIG. 33 is an enlarged side view of a bottom part of the antenna of FIG. 32A.
Figure 34A:
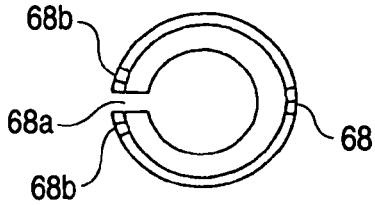
FIG. 34A is a top view of a claw washer in the antenna of FIG. 32A.
Figure 34B:
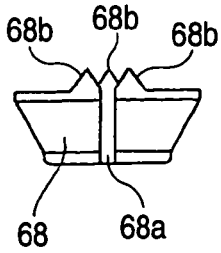
FIG. 34B is a front view of the claw washer of FIG. 34A.
Figure 34C:
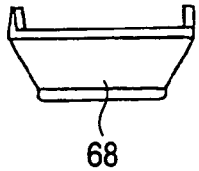
FIG. 34C is a side view of the claw washer of FIG. 34A.
Figure 34D:
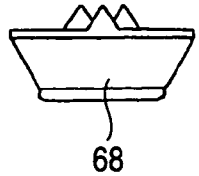
FIG. 34D is a rear view of the claw washer of FIG. 34A.
Figure 34E:
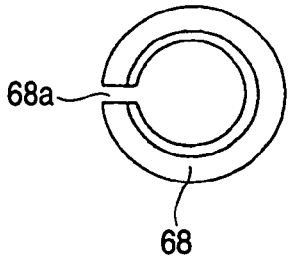
FIG. 34E is a bottom view of the claw washer of FIG. 34A.

In this embodiment, as shown in FIGS. 32A to 33, a wedge-shaped member 60*d*, which becomes narrower as it extends downwards, is formed in such a manner as to extend between the protrusion 10*a* and a circumferential face of the cylindrical portion 10*b*. This wedge-shaped member 60*d* is provided in such a manner as to be deviated through an appropriate angle in an opposite direction to a rotational direction of the bolt 20 relative to a longitudinal center line C of the antenna base 10. Moreover, a slope 60*e* is formed on an opposite face of the wedgeshaped member 60*d* to the rotational direction of the bolt 20 in which the bolt 20 is screwed to be tightened in such a manner as to extend to the vicinity of a lower face of the protrusion 10*a*. In addition, a cable hole 60*f* is opened vertically through the protrusion 10*a*, and the cable 22 is let out therefrom. The protrusion 10*a* and the like which are provided on the lower face of the antenna base 10 are provided in such a manner as to protrude downwards from a hole 14*a* provided at a substantially central portion of the rubber pad 14.

As shown in FIGS. 34A to 34E, a claw washer 68 is made of a sheet of conductive metal and is formed substantially into a truncated conical shape which becomes narrower as it extends downwards, the claw washer 68 being formed substantially C-shape, as viewed from a top thereof, by being partially cut to form a slit 68*a*. Then, three claws 68*b* are provided on an upper edge portion of the claw washer 68 at three locations of both end portions of the slit 68*a* and an opposite position to the slit 68*a* in such a manner as to project upwards therefrom. An outer diameter of the upper edge portion of the claw washer 68 including the claws 68*b* is set to such a dimension that allows the claws 68*b* to pass through the hole 24*a* in their natural state. In addition, an upper inner diameter of the upper edge portion of the claw washer 68 is set so as to be slightly larger than an outer diameter of the cylindrical portion 10*b* in its natural state.

Figure 35:
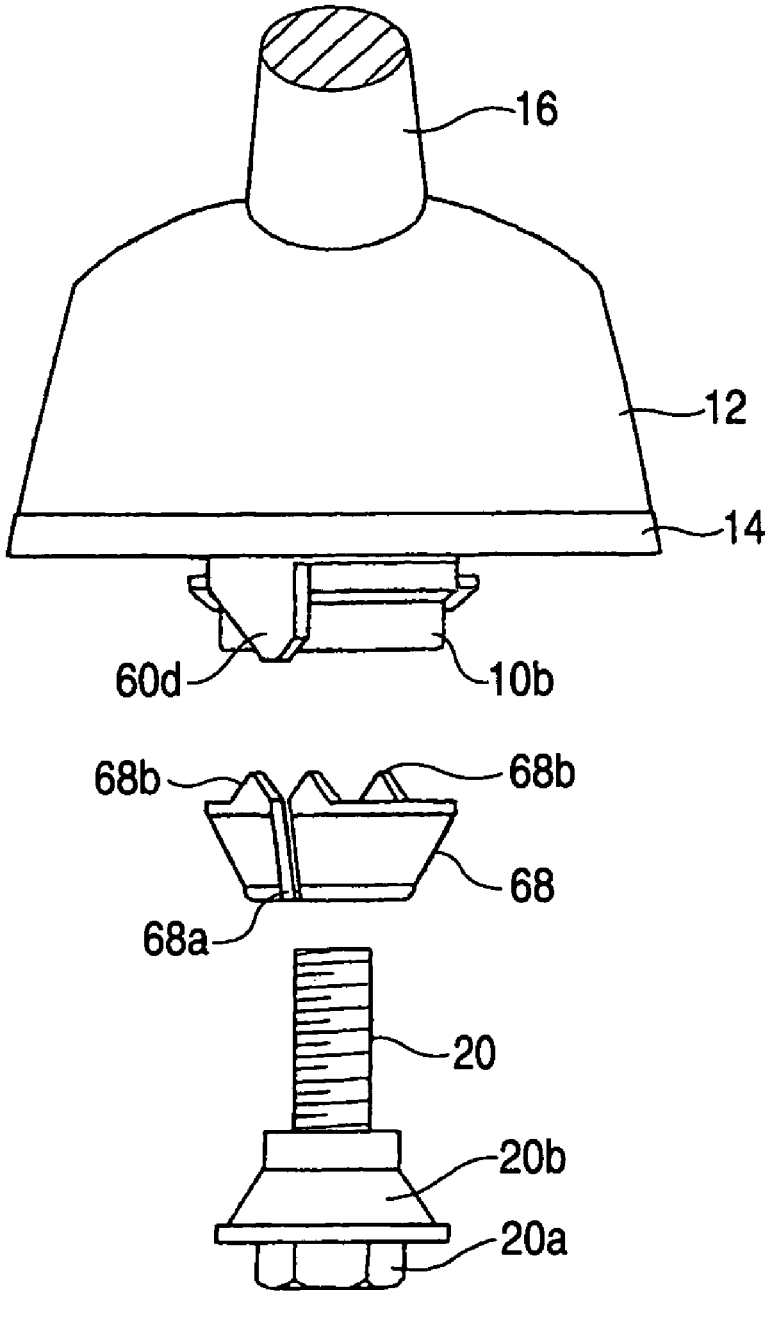
FIG. 35 is a side view showing members constituting a mounting structure for the antenna of FIG. 32A.

As shown in FIG. 35, the truncated-conical portion 20*b* of the bolt 20 is configured so as to become wider in a tapered shape from an upper end to a lower end thereof in such a manner that an upper outer diameter is slightly smaller while a lower outer diameter thereof is larger than a lower inner diameter of the claw washer 68 in its original state.

Figure 36:
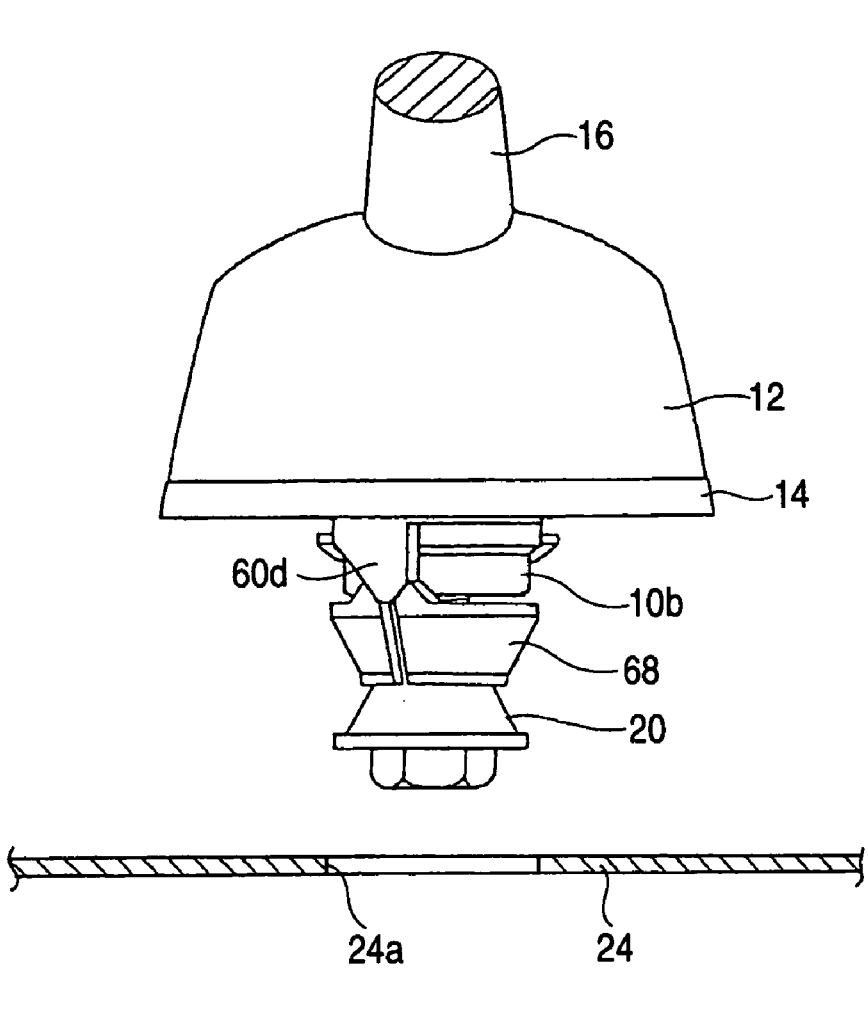
FIG. 36 is a partially sectional side view showing a state before the antenna of FIG. 32A is mounted on a vehicle body.

The assembly of the aforesaid respective members is implemented as arranged in FIG. 35, and a distal end portion of the bolt 20 on which the claw washer 68 is firstly fitted from therebelow is screwed into the internal thread 10*c* in the antenna base 10, whereby the bolt 20 and the claw washer 68 are integrated on to the antenna base 10 as shown in FIG. 36. Incidentally, the antenna base 10 and the claw washer 68 are disposed in such a positional relationship that the slit 68*a* in the claw washer 68 faces the wedge-shaped member 60*d* of the antenna base 10.

Figure 37:
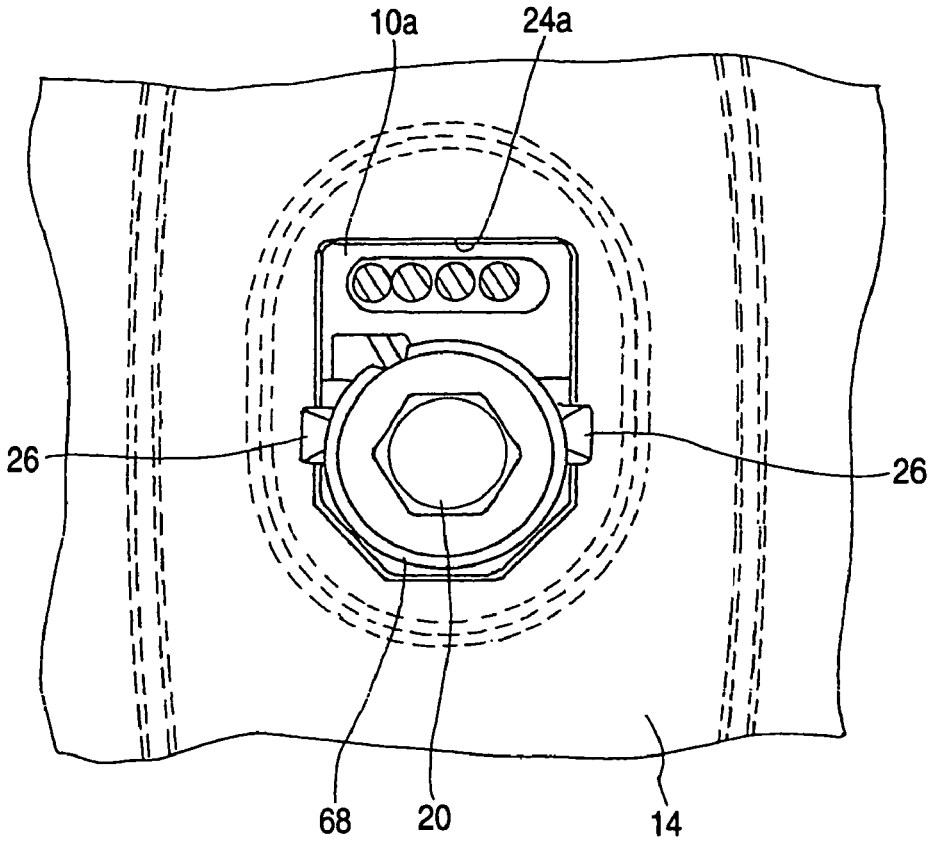
FIG. 37 is a schematic bottom view showing a state that the antenna of FIG. 32A is provisionally fixed on the vehicle body.

The integrated members are inserted into the hole 24*a* in the vehicle body 24 from thereabove. Here, the hole 24*a* in the vehicle body 24 is opened in a dimension which is slightly larger than a horizontal shape of the protrusion 10*a* of the antenna base 10. Then, when the protrusion 10*a* is inserted into the hole 24*a*, the rotation of the bolt 20 around the axis thereof is restricted and the positional deviation of the bolt 20 in a direction normal thereto is also restricted. Furthermore, with the protrusion 10*a* inserted into the hole 24*a*, the claws 26 are locked on the inner face of the circumferential edge portion of the hole 24*a* as shown in FIG. 37, whereby the antenna base 10 is restricted from being dislodged upwards. Thus, the antenna assembly is put in such a state that the assembly is provisionally fixed to the hole 24*a* in the vehicle body 24.

When the bolt 20 is strongly screwed into the internal thread 10*c* in the antenna base 10, the claw washer 68 is deformed by the wedge-shaped member 60*d* and the cylindrical portion 10*b* of the antenna base 10 and the truncated-conical portion 20*b* of the bolt 20 in such a manner that the diameter of the substantially C-shape thereof is increased, whereby the claw washer 68 is opened further. Then, the upper edge portion of the claw washer 68 is expanded so that the claws 68*b* are positioned on the inner face of the circumferential edge portion of the hole 24*a*. Furthermore, by continuing to strongly tighten the bolt 20, the claws 68*b* are made to bite into the inner face of the vehicle body 24 while being deviated in their positions, whereby the antenna base 10 is fixed to the vehicle body 24 while an electrical conduction to the vehicle body 24 is established via the bolt 20 and the claw washer 68.

Figure 38:
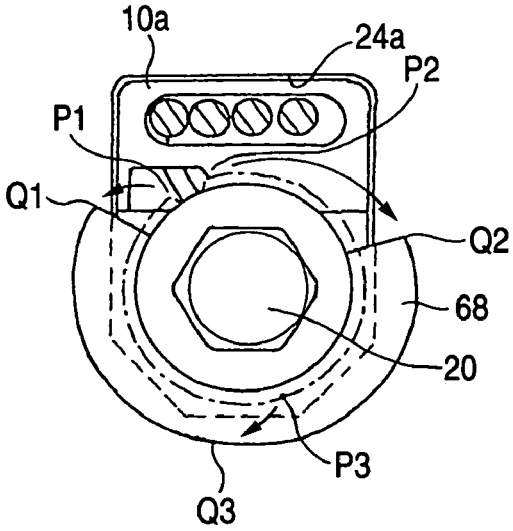
FIG. 38 is a schematic bottom view showing a state that the antenna of FIG. 32A is plenarily fixed on the vehicle body.

In the operation of expanding the claw washer 68, a force is caused to act on the claw washer 68 which attempts to rotate the claw washer 68 around the axis thereof together with the bolt 20 by a friction force generated in conjunction with the tightening rotation of the bolt 20. However, the one end portion of the slit 68*a* is in abutment with the slope 60*e* of the wedge-shaped member 60*d* of the antenna base 10 and hence, the position of the one end portion of the slit 68*a* is restricted. Since the one end portion of the slit 68*a* is deviated in position in an opposite direction to the direction in which the claw washer 68 is attempted to be rotated together with the bolt 20, as shown in FIG. 38, the claw 68*b* situated at the one end portion of the slit 68*a* is moved from P1 to Q1 so as to face the inner face of the circumferential edge portion of the hole 24*a*. In addition, the claw 68*b* situated at the other end portion of the slit 68*a* is expanded in the direction in which the claw washer 68 is attempted to be rotated together with the bolt 20 and is then moved largely from P2 to Q2, whereby the claw 68*b* situated at the other end portion of the slit 68*a* is positioned so as to face an opposite different position on the circumferential edge portion of the hole 24*a*. Furthermore, in conjunction with the enlargement in diameter of the claw washer 68, the remaining claw 68*b* that is provided opposite to the slit 68*a* is moved from P3 to Q3, so that the claw 68*b* is also positioned to face the inner face of the circumferential edge portion of the hole 24*a*.

Thus, when the diameter of the claw washer 68 is expanded, the distance over which each claw 68*b* provided at both the end portions of the slit 68*a* is moved differs largely between the movement to the direction in which the claw washer 68 is attempted to be rotated together with the bolt 20 and the movement to the opposite direction thereto as the bolt 20 is tightened. Then, by providing the wedge-shaped member 60*d* in such a manner as to be deviated through an appropriate angle in the opposite direction to the direction in which the claw washer 68 is attempted to be rotated together with the bolt 20 relative to the longitudinal center line C of the antenna base 10 in accordance with the difference in the distance over which the claws 68*b* are so moved, the claws 68*b* which are situated at both the end portions of the slit 68*a* can be positioned substantially symmetrical with each other with respect to the longitudinal center line C of the antenna base 10 when the claw washer 68 is expanded.

Accordingly, the claws 68*b* which are situated at both the end portions of the slit 68*a* can be made to face the inner face of the circumferential edge portion at the substantially symmetrical positions on both the sides of the hole 24*a*. In addition, the slope 60*e* of the wedge-shaped member 60*d* not only restricts the movement of the position of the claw 68*b* situated at the one end portion of the slit 68*a* in the direction in which the claw washer 68 is attempted to be rotated together with the bolt 20 but also allows the position of the claw 68*b* so situated to move in the opposite direction to the direction in which the claw washer 68 is attempted to be rotated together with the bolt 20. Consequently, by setting the slope 60*e* appropriately, the position of the claw 68*b* situated at the one end portion of the slit 68*a* can be surely made to face the circumferential edge portion of the hole 24*a*.

Next, a eleventh embodiment of the invention will be described with reference to FIG. 39. Components similar to those in the tenth embodiment will be designated by the same reference numerals and repetitive explanations for those will be omitted.

In the eighth embodiment, what largely differs from the tenth embodiment resides in that a bolt 42 is integrally provided on an antenna base 40 in such a manner as to project downwardly therefrom.

Then, a nut 44 formed of metal and including a truncated-conical portion 44*a* is screwed on the bolt 42. This truncated-conical portion 44*a* is formed so as to become wider from an upper end to a lower end thereof in such a manner that an upper outer diameter is smaller while a lower outer diameter is larger than a lower inner diameter of the claw washer 68.

Figure 39:
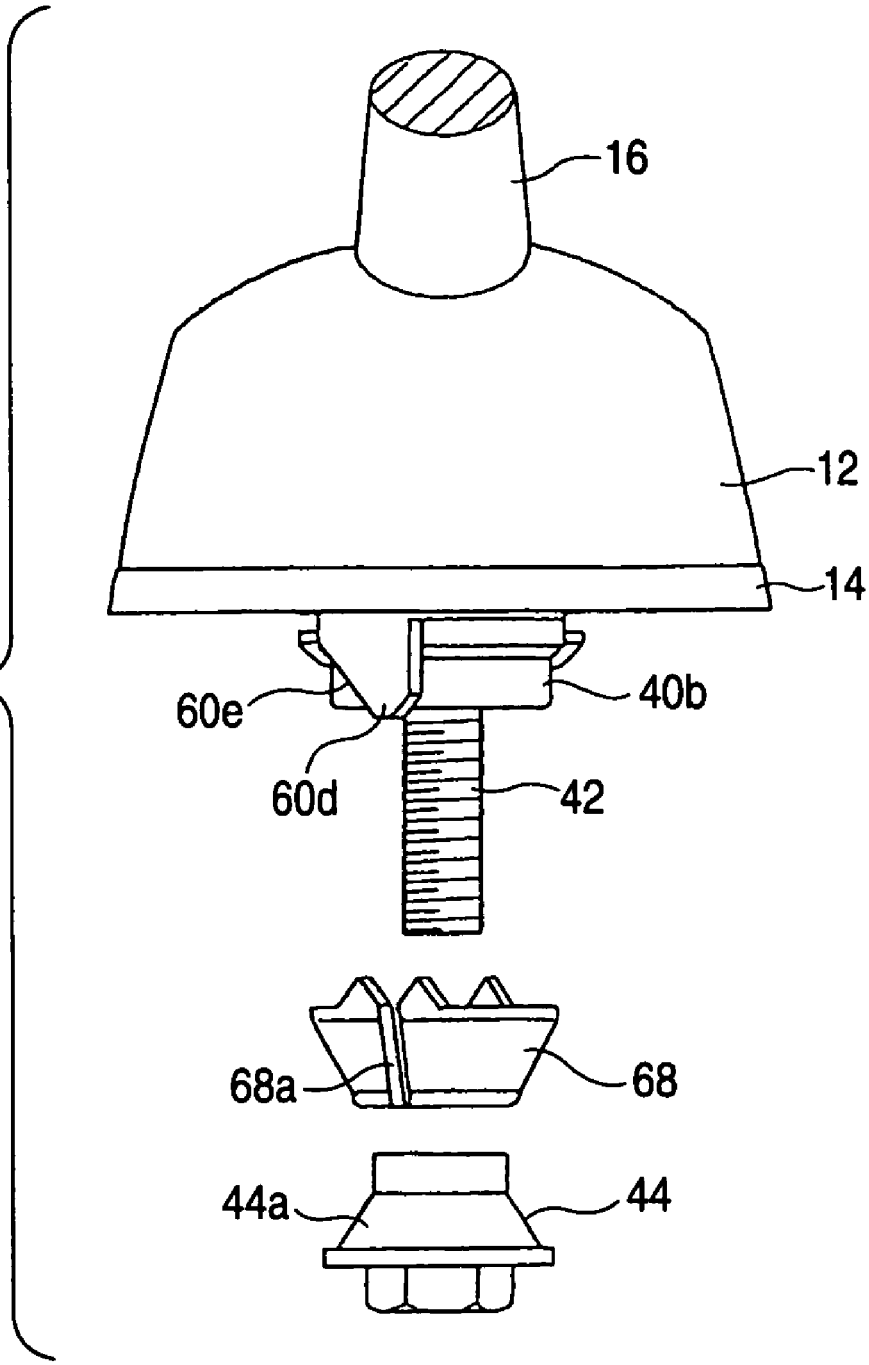
FIG. 39 is a side view showing members constituting a mounting structure for an antenna according to an eleventh embodiment of the invention.

Then, the respective members are arranged as shown in FIG. 39, and the claw washer 68 is fitted on the bolt 42 on the antenna base 10 so as to realize a positional relationship in which the slit 68*a* in the claw washer 68 faces the wedge-shaped member 60*d* of the antenna base 10, and the nut 44 is screwed on a lower end portion of the bolt 42, whereby the claw washer 68 and the nut 44 are integrated on to the antenna base 40. Then, similarly to the tenth embodiment, the integrated members so formed are inserted into the hole 24 from above the vehicle body 24 so as to be provisionally fixed by claws 26. When the nut 44 is tightened strongly, the antenna base 40 is fixed to the vehicle body 24 while obtaining an electrical conduction.

In place of the bolt 20 in the tenth embodiment, a truncated-conical bush 50 may be fitted on a normal bolt 52 having a head portion as shown in FIG. 30. This bush 50 is formed to become wider as it extends from an upper end to a lower end thereof in such a manner that an upper outer diameter is smaller while a lower outer diameter thereof is larger than a lower inner diameter of the claw washer 68.

The nut 44 of the eleventh embodiment may be divided into the truncated-conical bush 50 and a normal nut 54. Since the bush 50 is interposed between the daw washer 68 and the head of the bolt 52 and the bush 50 is also interposed between the claw washer 68 and the nut 54, a force acting on the claw washer 68 can be reduced which attempts to rotate the claw washer 68 around an axis thereof together with the bolt 52 and the nut 54 in conjunction with the rotation of the bolt 52 and the nut 54. Moreover, since the lower inner diameter of the claw washer 68 can be expanded by the bush 50, commercially available bolts and nuts can be used for the bolt 52 and the nut 54.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A structure for mounting an antenna device on a first side of a panel body, the structure comprising:

a first fixation member, having a tubular body, including a first end having a first width, a second end, and a slit connecting the first end and the second end;

a protrusion, protruded from the antenna device and fitted into the first end of the first fixation member; and a second fixation member, fitted into the second end of the first fixation member while being coupled with the protrusion in a screwing manner, wherein:

the first width is smaller than an aperture formed in the panel body when the protrusion and the second fixation member are in a first screwing position, so that the protrusion, the first fixation member and the second fixation member are allowed to pass through the aperture from the first side to a second side thereof; and the slit is expanded such that the first end of the first fixation member is made to have a second width which is greater than the aperture when the protrusion and the second fixation member are in a second screwing position where the protrusion and the second fixation member are closed to each other than the first screwing position.

2. The structure as set forth in claim 1, further comprising a wedge member, formed on at least one of the protrusion and the second fixation member, the wedge member fitted into the slit when the protrusion and the second fixation member are in the first screwing position, wherein the wedge member is configured so as to expand the slit when the protrusion and the second fixation member are in the second screwing position.

3. The structure as set forth in claim 2, wherein:

the wedge member is formed with a cutout portion; and a cable is extending from the antenna device and led to the second side of the panel body while passing through the cutout portion and the aperture.

4. The structure as set forth in claim 2, further comprising a plurality of claws, provided on the first end of the first fixation member at positions that are both sides of the slit, the claws being adapted to be bite into a second side of the panel body, wherein:

the second fixation member is rotated in a first direction to be placed in the second screwing position; and the wedge member has a slope face configured such that one of the claws, which is moved in the first direction in accompany with the rotation of the second fixation member, is abutted against the slope face and guided in a second direction opposite to the first direction while the second fixation member is moved to the second screwing member.

5. The structure as set forth in claim 4, wherein the wedge member is arranged at a position deviated in the second direction from a symmetric line of the aperture.

6. The structure as set forth in claim 1, wherein a first end of the second fixation member which is first fitted into the second end of the first fixation member has a first diameter and the second end of the second fixation member has a second diameter which is larger than the first diameter.

7. The structure as set forth in claim 1, wherein the aperture and the protrusion are shaped into rectangular.

8. The structure as set forth in claim 1, wherein the second fixation member is a bolt member adapted to be screwed into a hole formed in the protrusion, and the bolt has a head portion adapted to be fitted into the second end of the first fixing member to assist the wedge member to expand the slit.

9. The structure as set forth in claim 1, wherein the second fixation member is a nut member adapted to be fitted into the second end of the first fixing member and screwed on a bolt formed on the protrusion to assist the wedge member to expand the slit of the first fixation member.

* * * * *